US008357252B2

(12) United States Patent
Nagao et al.

(10) Patent No.: US 8,357,252 B2
(45) Date of Patent: Jan. 22, 2013

(54) HIGH TENSILE STRENGTH STEEL HAVING FAVORABLE DELAYED FRACTURE RESISTANCE AND METHOD FOR MANUFACTURING THE SAME

(75) Inventors: Akihide Nagao, Tokyo (JP); Kenji Oi, Tokyo (JP); Kenji Hayashi, Tokyo (JP); Nobuo Shikanai, Tokyo (JP)

(73) Assignee: JFE Steel Corporation (JP)

( * ) Notice: Subject to any disclaimer, the term of this patent is extended or adjusted under 35 U.S.C. 154(b) by 154 days.

(21) Appl. No.: 12/524,988

(22) PCT Filed: Jan. 31, 2008

(86) PCT No.: PCT/JP2008/052002

§ 371 (c)(1),
(2), (4) Date: Jul. 29, 2009

(87) PCT Pub. No.: WO2008/093897

PCT Pub. Date: Aug. 7, 2008

(65) Prior Publication Data

US 2010/0024926 A1 Feb. 4, 2010

(30) Foreign Application Priority Data

Jan. 31, 2007 (JP) ..... 2007-021573
Mar. 29, 2007 (JP) ..... 2007-086296

(51) Int. Cl.
*C21D 8/02* (2006.01)
*C22C 38/00* (2006.01)
*C22C 38/22* (2006.01)
*C22C 38/44* (2006.01)

(52) U.S. Cl. ..... 148/547; 148/330; 148/334; 148/335

(58) Field of Classification Search ..... 148/330, 148/334, 335, 547
See application file for complete search history.

(56) References Cited

U.S. PATENT DOCUMENTS 6,224,689 B1 5/2001 Koo et al.

FOREIGN PATENT DOCUMENTS

| | | | |
|---|---|---|---|
| EP | 1 659 191 | A1 | 5/2006 |
| JP | 2-236223 | A | 9/1990 |
| JP | 3-243745 | A | 10/1991 |
| JP | 9-078191 | A | 3/1997 |
| JP | 9-078193 | A | 3/1997 |
| JP | 2003-073737 | A | 3/2003 |
| JP | 2003-239041 | A | 8/2003 |
| JP | 2003-253376 | A | 9/2003 |
| JP | 2003-321743 | A | 11/2003 |
| JP | 2006-206942 | A | 8/2006 |

*Primary Examiner* — Stanley Silverman
*Assistant Examiner* — Alexander Polyansky
(74) *Attorney, Agent, or Firm* — DLA Piper LLP (US)

(57) ABSTRACT

High tensile strength steels that have both favorable delayed fracture resistance and a tensile strength of 600 MPa or higher and are suitably used in construction machinery, tanks, penstocks, and pipelines, as well as methods for manufacturing such steels are provided. The safety index of delayed fracture resistance (%) is $100\times(X_1/X_0)$, where $X_0$: reduction of area of a specimen substantially free from diffusible hydrogen, and $X_1$: reduction of area of a specimen containing diffusible hydrogen.

14 Claims, 2 Drawing Sheets

HIGH TENSILE STRENGTH STEEL HAVING FAVORABLE DELAYED FRACTURE RESISTANCE AND METHOD FOR MANUFACTURING THE SAME

RELATED APPLICATIONS

This is a §371 of International Application No. PCT/JP2008/052002, with an international filing date of Jan. 31, 2008 (WO 2008/093897 A1, published Aug. 7, 2008), which is based on Japanese Patent Application Nos. 2007-021573, filed Jan. 31, 2007, and 2007-086296, filed Mar. 29, 2007.

TECHNICAL FIELD

This disclosure relates to high tensile strength steels having favorable delayed fracture resistance and those having favorable delayed fracture resistance with the tensile strength thereof being 600 MPa or higher, in particular, 900 MPa or higher, as well as methods for manufacturing such steels.

BACKGROUND

Recently, in the fields involving the use of steels, such as construction machinery (e.g., moves and chassis for cranes), tanks, penstocks, and pipelines, the increasing size of structures urges steels to be stronger and also the use environment of such steels has been becoming progressively harsher.

However, strengthening of steels and a harsher use environment are generally known to increase the susceptibility of steels to delayed fractures. For example, in the field of high tensile bolts, JIS (Japanese Industrial Standards) B 1186 stipulates that the use of F11T bolts (tensile strength: 1100 to 1300 N/mm$^2$) should be avoided whenever possible, indicating that the use of high strength steels is limited.

In response to this, methods for manufacturing steels with favorable delayed fracture resistance have been proposed in publications including Japanese Unexamined Patent Application Publication No. H3-243745, Japanese Unexamined Patent Application Publication No. 2003-73737, Japanese Unexamined Patent Application Publication No. 2003-239041, Japanese Unexamined Patent Application Publication No. 2003-253376, and Japanese Unexamined Patent Application Publication No. 2003-321743. These methods are based on various techniques, such as optimization of components, strengthening of grain boundaries, decreasing the size of crystal grains, the use of hydrogen-trapping sites, control of structural morphology, and fine dispersion of carbides.

However, the methods described in the publications listed above, including Japanese Unexamined Patent Application Publication No. H3-243745, Japanese Unexamined Patent Application Publication No. 2003-73737, Japanese Unexamined Patent Application Publication No. 2003-239041, Japanese Unexamined Patent Application Publication No. 2003-253376, and Japanese Unexamined Patent Application Publication No. 2003-321743, do not produce sufficiently strong steels achieving a delayed fracture resistance level that is required in applications where they are exposed to a severely corrosive environment. Thus, steels having both better delayed fracture resistance and a high level of tensile strength, in particular, a tensile strength of 900 MPa or higher, and methods for manufacturing such steels are demanded.

Delayed fractures reportedly occur when hydrogen able to diffuse in steel at room temperature, namely so-called "diffusible hydrogen," gathers at a stress concentration zone and reaches the threshold limit value of the material. This threshold limit value depends on material strength, its structure, and other parameters.

In general, a delayed fracture of high strength steels starts from non-metallic inclusions, such as MnS, and grows along grain boundaries, such as prior austenite grain boundaries.

Thus, ways of improving delayed fracture resistance include reduction of the amount of non-metallic inclusions, such as MnS, and strengthening of prior austenite grain boundaries.

It could therefore be helpful to provide a high tensile strength steel having delayed fracture resistance better than that of known steels with the tensile strength thereof being 600 MPa or higher, in particular, 900 MPa or higher, as well as a method for manufacturing such a steel.

SUMMARY

We discovered that high tensile strength steels having delayed fracture resistance better than those of known steels can be obtained by the following principles: reduction of the amount of P and S that are impurity elements as well as extension of crystal grains and introduction of deformation bands via rolling of non-recrystallization regions can prevent the formation of MnS, non-metallic inclusions; a decrease in the covering density of grain boundaries of P, which is an impurity element, segregated in prior austenite grain boundaries, which may be followed by reduction of the amount of cementite precipitations formed in the boundaries of laths, can prevent a decrease in the strength of the prior austenite grain boundaries.

We thus provide:

1. A high tensile strength steel having favorable delayed fracture resistance, containing elements C: 0.02 to 0.25%, Si: 0.01 to 0.8%, Mn: 0.5 to 2.0%, Al: 0.005 to 0.1%, N: 0.0005 to 0.008%, P: 0.02% or lower, and S: 0.004% or lower, all in percent by mass, and Fe and unavoidable impurities as the balance, wherein the average aspect ratio of prior austenite grains calculated over the entire thickness is at least three;

2. The high tensile strength steel according to 1, wherein S: 0.003% or lower and the cementite covering ratio measured at boundaries of laths is 50% or lower;

3. The high tensile strength steel having favorable delayed fracture resistance according to 1 or 2, further containing one or more of Mo: 1% or lower, Nb: 0.1% or lower, V: 0.5% or lower, Ti: 0.1% or lower, Cu: 2% or lower, Ni: 4% or lower, Cr: 2% or lower, and W: 2% or lower, all in percent by mass;

4. The high tensile strength steel having favorable delayed fracture resistance according to 1 to 3, further containing one or more of B: 0.003% or lower, Ca: 0.01% or lower, REM: 0.02% or lower, and Mg: 0.01% or lower;

5. The high tensile strength steel having. favorable delayed fracture resistance according to any one of 1 to 4, wherein, hydrogen is charged into the steel and the hydrogen contained in the steel is sealed by zinc galvanizing, the safety index of delayed fracture resistance calculated using the formula described below being at least 75% when a slow strain rate test is performed with the strain rate set to $1\times10^{-3}$/s or lower:

$$\text{Safety index of delayed fracture resistance (\%)}=100\times(X_1/X_0)$$

where $X_0$: reduction of area of a specimen substantially free from diffusible hydrogen, and $X_1$: reduction of area of a specimen containing diffusible hydrogen;

6. The high tensile strength steel according to 5, wherein the safety index of delayed fracture resistance is at least 80%;

7. A method for manufacturing the high tensile strength steel having favorable delayed fracture resistance according to 5, including a step of casting steel having the composition according to any one of 1 to 4, a step of protecting the steel from cooling to the $Ar_3$ transformation temperature or lower or heating the steel to a temperature equal to or higher than the $Ac_3$ transformation temperature once again, a step of hot rolling to achieve a predetermined steel thickness including rolling conducted with the rolling reduction for non-recrystallization regions set to 30% or higher, a step of cooling the steel from a temperature equal to or higher than the $Ar_3$ transformation temperature to a temperature equal to or lower than 350° C. at a cooling rate of 1° C./s or higher, and a step of tempering the steel at a temperature equal to or lower than the $Ac_1$ transformation temperature;

8. The method according to 7, in which the steel is tempered at a temperature equal to or lower than the $Ac_1$ transformation temperature, for manufacturing the high tensile strength steel having favorable delayed fracture resistance according to 6, wherein a heating apparatus installed in a manufacturing line having a rolling mill and a cooling apparatus is used to heat the steel from 370° C. to a predetermined tempering temperature equal to or lower than the $Ac_1$ transformation while maintaining the average heating rate for heating the middle of the steel thickness at 1° C./s or higher so that the maximum tempering temperature at the middle of the steel thickness is 400° C. or higher; and 9. The method according to 8, in which the steel is tempered at a temperature equal to or lower than the $Ac_1$ transformation temperature, for manufacturing the high tensile strength steel having favorable delayed fracture resistance according to 6, wherein the steel is heated from a tempering initiation temperature to 370° C. with the average heating rate for heating the middle of the steel thickness maintained at 2° C./s or higher.

We enable manufacturing high tensile strength steels having excellent delayed fracture resistance with the tensile strength thereof being 600 MPa or higher, in particular, 900 MPa or higher, and thus has very high industrial applicability.

DETAILED DESCRIPTION

Component Compositions

Figure 1:
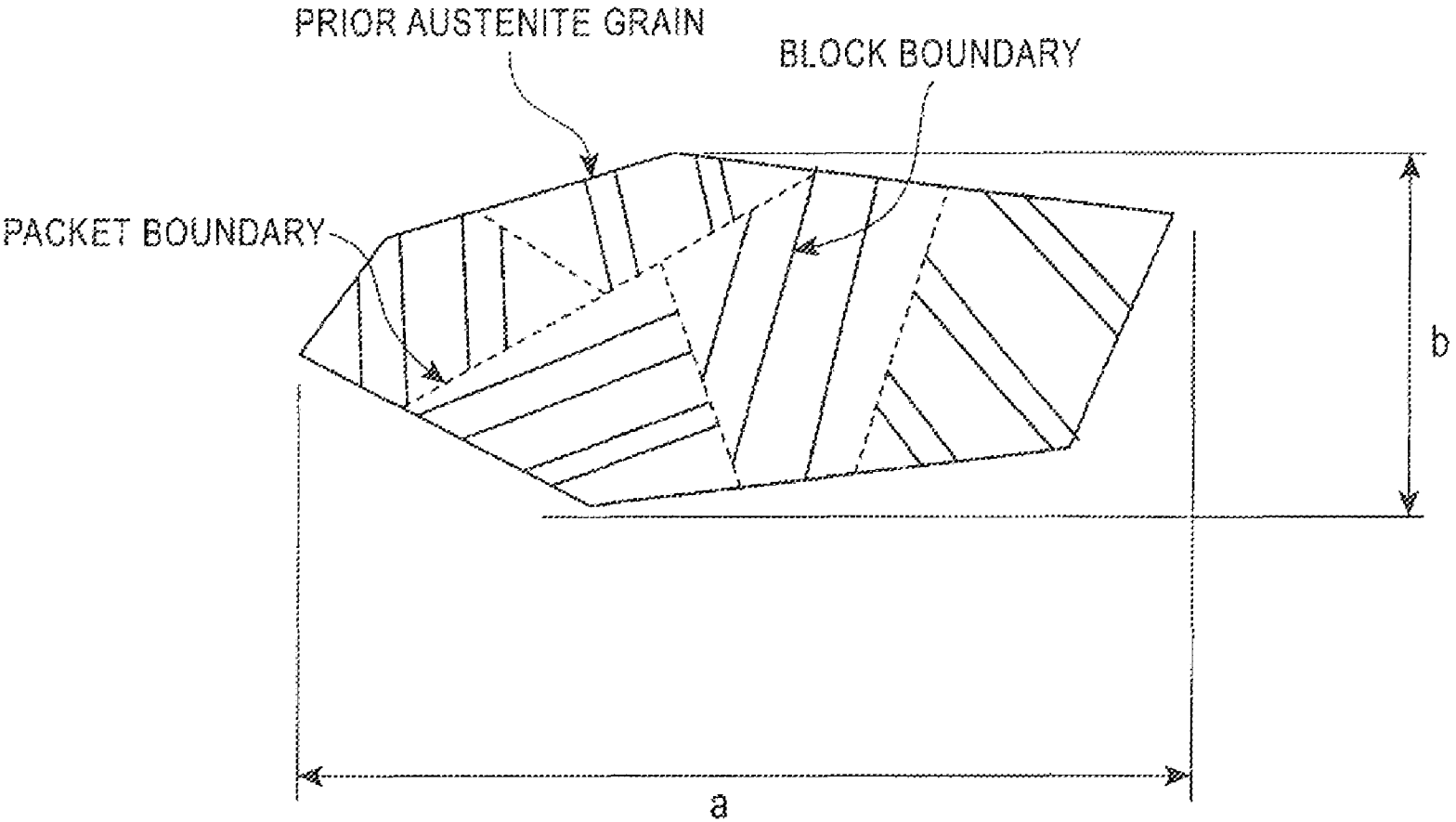
FIG. 1: A schematic diagram of a martensite structure.

The following are reasons for selection of the components. The percentages representing the content ratios of chemical components are all in percent by mass. C: 0.02 to 0.25%

C ensures strength. C contained at a content ratio lower than 0.02% would have an insufficient effect, whereas C contained at a content ratio higher than 0.25% would result in reduced toughness of the base material and weld-heat-affected zones and significantly deteriorated weldability. Therefore, the content ratio of C should be in the range of 0.02 to 0.25% and is preferably in the range of 0.05 to 0.20%.

Si: 0.01 to 0.8%

Si is used as a deoxidizing material and a reinforcing element in a steel-making process. Si contained at a content ratio lower than 0.01% would have an insufficient effect, whereas Si contained at a content ratio higher than 0.8% would make grain boundaries brittle, thereby promoting the development of delayed fractures. Therefore, the content ratio of Si should be in the range of 0.01 to 0.8% and is preferably in the range of 0.1 to 0.5%.

Mn: 0.5 to 2.0%

Mn ensures strength and, during the tempering step, is concentrated in cementite to prevent coarsening thereof by diffusing as substitutional atoms to limit the cementite growth rate. Mn contained at a content ratio lower than 0.5% would have an insufficient effect, whereas Mn contained at a content ratio higher than 2.0% would result in reduced toughness of weld-heat-affected zones and significantly deteriorated weldability. Therefore, the content ratio of Mn should be in the range of 0.5 to 2.0% and is preferably in the range of 0.7 to 1.8%.

Al: 0.005 to 0.1%

Al is added as a deoxidizing material also having the effect of downsizing the diameters of crystal grains. Al contained at a content ratio lower than 0.005% would have an insufficient effect, whereas Al contained at a content ratio higher than 0.1% would increase the risk of surface flaws of resulting steels. Therefore, the content ratio of Al should be in the range of 0.005 to 0.1% and is preferably in the range of 0.01 to 0.05%.

N: 0.0005 to 0.008%

N binds to Ti or the like to form nitrides that reduce the size of resulting structures, thereby improving the toughness of the base material and weld-heat-affected zones. N contained at a content ratio lower than 0.0005% would result in insufficient downsizing of the resulting structures, whereas N contained at a content ratio higher than 0.008% would lead to an increased amount of a solid solution of N, thereby reducing the toughness of the base material and weld-heat-affected zones. Therefore, the content ratio of N should be in the range of 0.0005 to 0.008% and is preferably in the range of 0.001 to 0.005%.

P: 0.02% or Lower

P, which is an impurity element, is often segregated in crystal grain boundaries such as prior austenite grains during the tempering process. P contained at a content ratio higher than 0.02% would result in weakened bonds between adjacent crystal grains, thereby reducing low-temperature toughness and delayed fracture resistance. Therefore, the content ratio of P should be 0.02% or lower and is preferably 0.015% or lower.

S: 0.004% or Lower

S, which is an impurity element, often forms non-metallic inclusions, MnS. S contained at a content ratio higher than 0.004% would produce a vast amount of inclusions and thus reduce ductile fracture resistance, thereby deteriorating low-temperature toughness and delayed fracture resistance. Therefore, the content ratio of S should be 0.004% or lower and is preferably 0.003% or lower.

The following components may also be added if desired.

Mo: 1% or Lower

Mo has the effect of improving quenching properties and strength and forms carbides that trap diffusible hydrogen and enhance delayed fracture resistance. To achieve these effects, the content ratio of Mo is preferably 0.05% or higher. However, the addition of Mo at a content ratio higher than 1% would be uneconomic. Therefore, when Mo is added, the content ratio thereof should be 1% or lower and is preferably 0.8% or lower. It should be noted that Mo has the effect of improving temper softening resistance and thus, to ensure a strength of 900 MPa or higher, the content ratio thereof is preferably 0.2% or higher.

Nb: 0.1% or Lower

Nb is a microalloying element that improves strength, and forms carbides, nitrides, and carbonitrides that trap diffusible hydrogen and enhance delayed fracture resistance. To achieve these effects, the content ratio of Nb is preferably 0.01% or higher. However, the addition of Nb at a content ratio higher than 0.1% would result in reduced toughness of weld-heat-affected zones. Therefore, when Nb is added, the content ratio thereof should be 0.1% or lower and is preferably 0.05% or lower.

V: 0.5% or Lower

V is a microalloying element that improves strength, and forms carbides, nitrides, and carbonitrides that trap diffusible hydrogen and enhance delayed fracture resistance. To achieve these effects, the content ratio of V is preferably 0.02% or higher. However, the addition of V at a content ratio higher than 0.5% would result in reduced toughness of weld-heat-affected zones. Therefore, when V is added, the content ratio thereof should be 0.5% or lower and is preferably 0.1% or lower.

Ti: 0. 1% or Lower

When hot-rolled or welded, Ti forms TiN to prevent the growth of austenite grains, thereby improving the toughness of the base material and weld-heat-affected zones, and forms carbides, nitrides, and carbonitrides that trap diffusible hydrogen and enhance delayed fracture resistance. To achieve these effects, the content ratio of Ti is preferably 0.005% or higher. However, the addition of Ti at a content ratio higher than 0.1% would result in reduced toughness of weld-heat-affected zones. Therefore, when Ti is added, the content ratio thereof should be 0.1% or lower and is preferably 0.05% or lower.

Cu: 2% or Lower

Cu has the effect of improving strength through solid solution strengthening and precipitation strengthening. To achieve this effect, the content ratio of Cu is preferably 0.05% or higher. However, the addition of Cu at a content ratio higher than 2% would increase the risk of hot tearing that occurs during heating slabs or welding. Therefore, when Cu is added, the content ratio thereof should be 2% or lower and is preferably 1.5% or lower.

Ni: 4% or Lower

Ni has the effect of improving toughness and quenching properties. To achieve this effect, the content ratio of Ni is preferably 0.3% or higher. However, the addition of Ni at a content ratio higher than 4% would be uneconomic. Therefore, when Ni is added, the content ratio thereof should be 4% or lower and is preferably 3.8% or lower.

Cr: 2% or Lower

Cr has the effect of improving strength and toughness and is excellent in terms of high-temperature strength properties. Furthermore, during the tempering step, Cr is concentrated in cementite to prevent coarsening thereof by diffusing as substitutional atoms to limit the cementite growth rate. Thus, it is preferable to add Cr whenever possible for the purposes of improving strength, preventing coarsening of cementite, and, in particular, achieving a tensile strength of 900 MPa or higher, at a content ratio of 0.3% or higher. However, the addition of Cr at a content ratio higher than 2% would result in reduced weldability. Therefore, when Cr is added, the content ratio thereof should be 2% or lower and is preferably 1.5% or lower.

W: 2% or Lower

W has the effect of improving strength. To achieve this effect, the content ratio of W is preferably 0.05% or higher. However, the addition of W at a content ratio higher than 2% would result in reduced weldability. Therefore, when W is added, the content ratio thereof should be 2% or lower.

B: 0.003% or Lower

B has the effect of improving quenching properties. To achieve this effect, the content ratio of B is preferably 0.0003% or higher. However, the addition of B at a content ratio higher than 0.003% would result in reduced toughness. Therefore, when B is added, the content ratio thereof should be 0.003% or lower.

Ca: 0.01% or Lower

Ca is an element essential to control the morphology of sulfide inclusions. To achieve this effect, the content ratio of Ca is preferably 0.0004% or higher. However, the addition of Ca at a content ratio higher than 0.01% would result in reduced cleanliness and delayed fracture resistance. Therefore, when Ca is added, the content ratio thereof should be 0.01% or lower.

REM: 0.02% or Lower

REM (note: REM is an abbreviation representing Rare Earth Metal) forms REM (rare-earth metal) oxysulfides, namely REM (O, S), in steel to reduce the amount of solid solution S at crystal grain boundaries, thereby improving SR (stress relief) cracking resistance (in other words, PWHT (post welded heat treatment) cracking resistance). To achieve this effect, the content ratio of REM is preferably 0.001% or higher. However, the addition of REM at a content ratio higher than 0.02% would cause material deterioration due to significant deposition of REM oxysulfides on precipitated crystal bands. Therefore, when REM is added, the content ratio thereof should be 0.02% or lower.

Mg: 0.01% or Lower

Mg is used as a hot metal desulfurization agent in some cases. To achieve this effect, the content ratio of Mg is preferably 0.001% or higher. However, the addition of Mg at a content ratio higher than 0.01% would result in reduced cleanliness. Therefore, when Mg is added, the content ratio thereof should be 0.01% or lower.

Microstructure

The following are reasons for selection of the microstructure.

The representative structures of the high strength steel are martensite and bainite. In particular, a martensite structure has, as shown in the schematic structure diagram of FIG. 1, a fine and complex morphology in which a plurality of four kinds of characteristic structure units (prior austenite, packets, blocks, and laths) are layered. The packets described herein are defined as regions each consisting of a population of parallel laths having the same habit plane. The blocks consist of a population of parallel laths having the same orientation.

The average aspect ratio of prior austenite grains calculated over the entire steel thickness (in FIG. 1, the ratio a/b between the major axis a and the minor axis b of the prior austenite grain) is at least three and preferably at least four.

The aspect ratio of prior austenite grains being at least three reduces the grain boundary covering ratio of P segregated in prior austenite grain boundaries, packet boundaries, or the like, thereby improving low-temperature toughness and delayed fracture resistance, and such microstructures distributing over the entire steel thickness provide homogenous steel having the properties described above.

To measure the aspect ratio of prior austenite grains, prior austenite grains are developed using, for example, picric acid, and then image analysis is performed to simply average aspect ratios of, for example, 500 or more prior austenite grains.

The state in which the average aspect ratio of prior austenite grains calculated over the entire thickness is at least three means that the average aspect ratio calculated from values obtained at the following positions is at least three and preferably at least four: 1 mm in depth from the surface of steel, positions located at ¼, ½, and ¾ of the steel thickness, and 1 mm in depth from the back surface of the steel.

Figure 2:
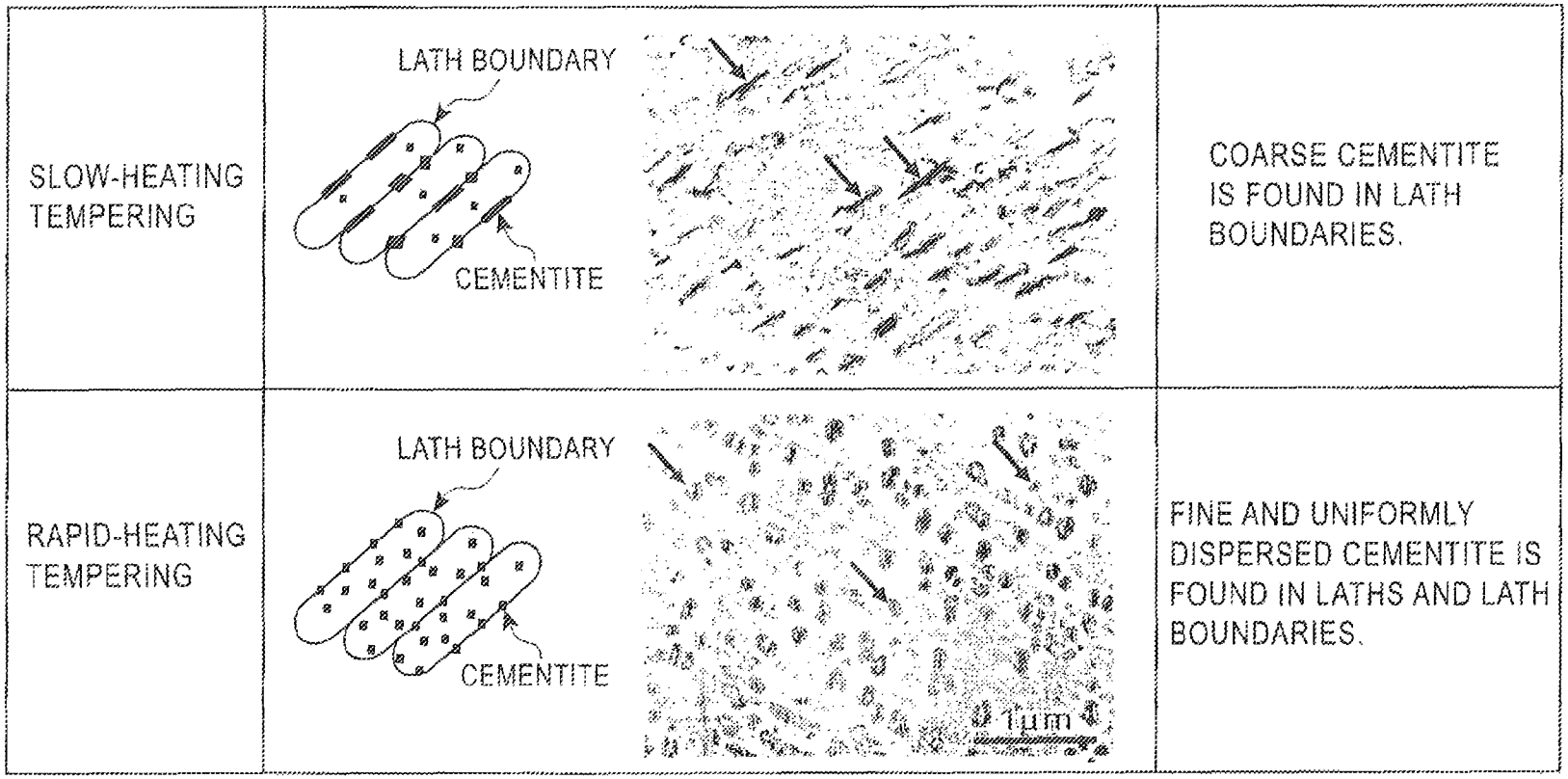
FIG. 2: Schematic diagrams and transmission electron microscope (TEM) images (extracted replicas) showing cementite precipitations formed in the boundaries of laths during slow-heating tempering and rapid-heating tempering.

In addition to the findings described above, we found that reducing the ratio of cementite precipitating in the boundaries between many fine laths generated in the blocks illustrated in FIG. 1 (hereinafter, referred to as the cementite covering ratio of lath boundaries) to 50% or lower particularly prevents a decrease in the strength. of prior austenite grain boundaries and thus improves delayed fracture resistance. Preferably, the cementite covering ratio of lath boundaries is 30% or lower. FIG. 2 includes schematic diagrams and TEM images showing cementite precipitations formed in the boundaries of laths.

The cementite covering ratio of lath boundaries is determined by imaging a structure developed using nital (a solution of nitric acid and an alcohol) with a scanning electron microscope as shown in FIG. 2; analyzing, for example, 50 or more laths in the obtained image in terms of the lengths of formed cementite precipitations along the lath boundaries ($L_{Cementite}$) and the lengths of the lath boundaries ($L_{Lath}$); dividing the sum of the lengths of cementite along the lath boundaries by the sum of the lengths of the lath boundaries; and then multiplying the quotient by 100.

Safety Index of Delayed Fracture Resistance

Hydrogen is charged into the steel and the hydrogen contained in the steel is sealed by zinc galvanizing, the safety index of delayed fracture resistance calculated using the formula described below being at least 75% and preferably at least 80% when a slow strain rate test is performed with the strain rate set to $1\times10^{-3}$/s or lower:

$$\text{Safety index of delayed fracture resistance (\%)}=100\times(X_1/X_0)$$

where $X_0$: reduction of the area of a specimen substantially free from diffusible hydrogen, and $X_1$: reduction of the area of a specimen containing diffusible hydrogen.

The safety index of delayed fracture resistance is a quantitative measure of delayed fracture resistance of steel, and the higher this index is, the better the delayed fracture resistance is. In the practical use of steel under normal atmospheric conditions, the safety index of delayed fracture resistance for sufficiently high delayed fracture resistance is 75% or higher and preferably 80% or higher. In some cases, however, steels having a tensile strength less than 1200 MPa would be used under harsh conditions such as a corrosive environment and lower temperatures or be difficult to process. Therefore, it is desirable that the safety index of delayed fracture resistance is 80% or higher and more preferably 85% or higher.

Manufacturing Conditions

We provide various forms of steels such as steel plates, steel shapes, and steel bars. The temperature specifications described in the manufacturing conditions are applicable to temperatures measured at the center of steel. As for steel plates, the center of the steel is taken as the middle of the steel thickness. As for steel shapes, it is taken as the middle of the steel thickness measured at a site to which selected properties are given. As for steel bars, it is taken as the middle of diameter. It should be noted that the surroundings of the center of steel experience temperature changes similar to those at the center, and thus the scope of the temperature specifications is not limited to the center itself Cast Conditions Our steels are effective regardless of casting conditions used to manufacture steels, and thus particular limitations on cast conditions are unnecessary. Any method can be used in manufacturing of cast slabs from liquid steel and rolling of the cast slabs to produce billets. Examples of methods that can be used to melt steel include converter processes and electric furnace processes, and examples of methods that can be used to produce slabs include continuous casting and ingot-based methods.

Hot-Rolling Conditions

In rolling of cast slabs to produce billets, the cast slabs may be protected from cooling to the $Ar_3$ transformation temperature or lower or allowed to cool and then heated to a temperature equal to or higher than the $Ac_3$ transformation temperature once again before the start of hot rolling. This is because effectiveness is ensured whenever rolling is started as long as the temperature at that time is in the range described above.

The rolling reduction for non-recrystallization regions is 30% or higher and preferably 40% or higher, and rolling is finished at a temperature equal to or higher than the $Ar_3$ transformation temperature. The reason why non-recrystallization regions are rolled with the rolling reduction being 30% or higher is because hot rolling performed in this way leads to extension of austenite grains and, at the same time, introduces deformation bands, thereby reducing the grain boundary covering ratio of P segregated in the grain boundaries during the tempering process. Higher aspect ratios of prior austenite grains would reduce effective grain sizes (sizes of grains that are fracture appearance units or, more specifically, packets) and the grain boundary covering ratios of P covering the prior austenite grains, packet boundaries, or the like, thereby improving delayed fracture resistance.

No particular limitation is imposed on formulae used to calculate the $Ar_3$ transformation temperature (° C.) and the $Ac_3$ transformation temperature (° C.). For example, $Ar_3$=910−310C−80Mn−20Cu−15Cr−55Ni−80Mo, and $Ac_3$=854−180C+44Si−14Mn−17.8Ni−1.7Cr. In these formulae, each of the elements represents the content ratio (percent by mass) thereof in the steel.

Post-Hot-Rolling Cooling Conditions

After the completion of hot rolling, the steel is forcedly cooled from a temperature equal to or higher than the $Ar_3$ transformation temperature to a temperature of 350° C. or lower at a cooling rate of 1° C./s or higher to ensure the strength and toughness of the base material. The reason why the forced-cooling initiation temperature is equal to or higher than the $Ar_3$ transformation temperature is because steel plates should consist of austenite phases only in the start of cooling. Cooling started when the temperature is lower than the $Ar_3$ transformation temperature would result in unevenly tempered structures and reduced toughness and delayed fracture resistance. The reason why steel plates are cooled to a temperature of 350° C. or lower is because such a low temperature is required to complete transformation from austenite to martensite or bainite, thereby improving the toughness and delayed fracture resistance of the base material. The cooling rate used in this process is 1° C./s or higher and preferably 2° C./s or higher. It should be noted that the cooling rate is defined as the average cooling rate obtained by dividing the temperature difference required in cooling the steel after hot rolling it from a temperature equal to or higher than the $Ar_3$ transformation temperature to a temperature of 350° C. or lower by the time required in this cooling process.

Tempering Conditions

The tempering process is performed at a certain temperature that makes the maximum temperature at the middle of the steel thickness equal to or lower than the $Ac_1$ transformation temperature. The reason why the maximum temperature should be equal to or lower than the $Ac_1$ transformation temperature is because, when it exceeds the $Ac_1$ transformation temperature, austenite transformation significantly reduces strength. Meanwhile, in this tempering process, an on-line heating apparatus installed in a manufacturing line having a rolling mill and a cooling apparatus and after the cooling apparatus is preferably used. This shortens the time required in the process including rolling, quenching, and tempering, thereby improving the productivity.

In this tempering process, the heating rate is preferably 0.05° C./s or higher. A heating rate lower than 0.05° C./s would increase the amount of P segregated in prior austenite grains, packet boundaries, or the like during tempering, thereby deteriorating low-temperature toughness and delayed fracture resistance. In addition, in slow heating where the heating rate for tempering is 2° C./s or lower, the time for which the tempering temperature is maintained is preferably 30 min or shorter because such a tempering time would prevent the growth of precipitations such as cementite and improve the productivity.

More preferred tempering conditions are rapid-heating conditions where the average heating rate for heating the middle of the steel thickness from 370° C. to a certain temperature equal to or lower than the $Ac_1$ transformation temperature is 1° C./s or higher and the maximum temperature at the middle of the steel thickness is 400° C. or higher.

The reason why the average heating rate is 1° C./s or higher is because such a heating rate would reduce the grain boundary covering density of P, an impurity element segregated in prior austenite grain boundaries, packet boundaries, or the like, and achieve lath boundaries with a reduced amount of cementite precipitations, which are shown in FIG. 2 providing the comparison between the slow-heating tempering and the rapid-heating tempering in terms of the schematic diagram and the TEM image showing cementite precipitations formed in the boundaries of laths.

More effective prevention of grain boundary segregation of P in prior austenite grain boundaries, packet boundaries, or the like would be preferably achieved by performing rapid heating where the average heating rate at the middle of the steel thickness for heating from the tempering initiation temperature to 370° C. is 2° C./s or higher in addition to the above-described rapid heating process, where the average heating rate at the middle of the steel thickness for heating from 370° C. to a certain tempering temperature equal to or lower than the $Ac_1$ transformation temperature is 1° C./s or higher.

The reason why the average heating rate at the middle of the steel thickness for heating from the tempering initiation temperature to 370° C. is 2° C./s or higher is because segregation of P in prior austenite grain boundaries, packet boundaries, or the like is particularly promoted in this temperature range.

Meanwhile, when the average heating rate at the middle of the steel thickness for heating from 370° C. to a certain tempering temperature equal to or lower than the $Ac_1$ transformation temperature is 1° C./s or higher and the average heating rate at the middle of the steel thickness for heating from the tempering initiation temperature to 370° C. is 2° C./s or higher, the time for which the tempering temperature is maintained is preferably 60 s or shorter because such a tempering time would prevent a decrease in productivity and deterioration of delayed fracture resistance due to coarsening of precipitations such as cementite. In addition, the heating rate is defined as the average heating rate obtained by dividing the temperature difference required in reheating the steel to a certain temperature so that the maximum temperature at the middle of the steel thickness is equal to or lower than the $Ac_1$ transformation temperature after cooling it by the time required in this reheating process.

The average cooling rate for cooling the tempered steel from the tempering temperature to 200° C. is preferably 0.05° C./s or higher to prevent coarsening of precipitations during this cooling process.

Meanwhile, the heating method for tempering may be induction heating, energization heating, infra-red radiant heating, furnace heating, or any other heating method.

The tempering apparatus may be a heating apparatus installed in a manufacturing line that is different from one having a rolling mill and a direct quenching apparatus or that installed in a manufacturing line having a rolling mill and a direct quenching apparatus so as to be directly connected to them. None of these heating apparatuses spoils the advantageous effect.

EXAMPLE 1

Tables 1 and 2 show the chemical compositions of the steels used in this example, whereas Tables 3 and 4 show the steel manufacturing conditions and aspect ratios of prior austenite grains.

Steels A to Z and AA to II whose chemical compositions are shown in Tables 1 and 2 were melted and cast into slabs (slab dimensions: 100 mm in height×150 mm in width×150 mm in length). The obtained slabs were heated in a furnace to the heating temperatures shown in Tables 3 and 4 and then hot-rolled with the rolling reduction for non-recrystallization regions set to the values shown in Tables 3 and 4 to produce steel plates. After the hot-rolling process, the steel plates were directly quenched with the direct quenching initiation temperatures, direct quenching termination temperatures, and cooling rates set to the values shown in Tables 3 and 4 and then tempered using solenoid type induction heating apparatus with the tempering initiation temperatures, tempering temperatures, and tempering times set to the values shown in Tables 3 and 4. The direct quenching was completed by forcedly cooling (cooling in water) the individual steel plates to a temperature of 350° C. or lower at a cooling rate of 1° C./s or higher.

The average heating rates at the middle of the steel thickness were achieved by controlling the threading rates of the steel plates. In addition, each steel plate was moved back and forth in the solenoid type induction heating apparatus while being heated so that its temperature was maintained in the range ±5° C. of the target heating temperature.

The cooling process after heating for tempering was completed by performing air cooling under the conditions shown in Tables 3 and 4. The temperatures, such as tempering temperatures and quenching temperatures, at the middle of the thickness of each steel plate were determined by heat transfer calculation based on temperatures dynamically measured on the surface thereof using an emission pyrometer.

Tables 5 and 6 show the yield strength, tensile strength, fracture appearance transition temperatures (vTrs), and safety indices of delayed fracture resistance of the obtained steel plates.

Each cooling rate was the average cooling rate for cooling from the direct quenching initiation temperature to the direct quenching termination temperature measured at the middle of the thickness of the steel plate.

For the tests described later, three specimens were sampled from the midpoint of the longitudinal axis of each steel plate, and additional three specimens were sampled from the position located at ¼ of the width of each steel plate.

The aspect ratios of prior austenite grains were determined by etching the structures of the specimens with picric acid, imaging each specimen using an optical microscope at 1 mm in depth from the surface thereof, positions located at ¼, ½, and ¾ of the thickness thereof, and 1 mm in depth from the back surface thereof, measuring the aspect ratios of approximately 500 prior austenite grains, and then averaging the aspect ratio measurements.

The yield strength and tensile strength were measured using specimens for the overall thickness tensile test according to JIS Z2241. The toughness was evaluated using the Charpy pendulum impact test according to JIS Z2242, in which vTrs of specimens sampled from the middle of the thickness of each steel plate was measured.

The safety indices of delayed fracture resistance were evaluated using rod-like specimens in the following way: hydrogen was charged into the specimens by cathodic hydrogen charging so that the amount of diffusible hydrogen contained in each specimen was approximately 0.5 mass ppm; the hydrogen was sealed by zinc galvanizing of the surface of each specimen; tensile tests of the specimens were performed with the strain rate set to $1\times10^{-6}$/s and the reductions of area of the fractured specimens were measured; and then the same tensile tests were performed using other specimens, into which no hydrogen was charged. The obtained results were used to evaluate the safety indices of delayed fracture resistance in accordance with the following formula:

$$\text{Safety index of delayed fracture resistance (\%)}=100\times(X_1/X_0)$$

where $X_0$: reduction of area of a specimen substantially free from diffusible hydrogen, and $X_1$: reduction of area of a specimen containing diffusible hydrogen.

The target vTrs was set to −40° C. or lower for steels having a tensile strength less than 1200 MPa and −30° C. or lower for steels having a tensile strength of 1200 MPa or higher. On the other hand, the target safety index of delayed fracture resistance was set to 80% or higher for steels having a tensile strength less than 1200 MPa and 75% or higher for steels having a tensile strength of 1200 MPa or higher.

As is clear in Tables 3 and 4, the steel plates 18 to 20, in which the rolling reduction for non-recrystallization regions deviated from our range, had the aspect ratios of prior austenite grains deviating from our range.

Furthermore, as is clear in Tables 5 and 6, the steel plates 1 to 17 and 33 to 39 (our examples) were produced under manufacturing conditions falling within our range to have a chemical component and the aspect ratio of prior austenite grains falling within our ranges, and showed favorable vTrs and a high safety index of delayed fracture resistance.

However, in the comparative steel plates 18 to 32 and 40 to 44 (comparative examples), at least one of vTrs and the safety index of delayed fracture resistance deviated from the target range thereof described above. The following are specific explanations of these comparative examples.

The steel plates 29 to 32 and 40 to 44 produced with the composition deviating from our range showed vTrs and/or the safety index of delayed fracture resistance being short of the target value.

The steel plates 18 to 20 produced with the rolling reduction for non-crystallization regions deviating from our range showed the safety index of delayed fracture resistance being short of the target value.

The steel plates 21 to 23 produced with the direct quenching initiation temperature deviating from our range showed vTrs and the safety index of delayed fracture resistance being short of the target value.

The steel plate 24 produced with the direct quenching termination temperature deviating from our range showed vTrs and the safety index of delayed fracture resistance being short of the target value.

The steel plate 25 produced with the cooling rate and direct quenching termination temperature deviating from our ranges showed vTrs and the safety index of delayed fracture resistance being short of the target value.

The steel plates 26 to 28 produced with the tempering temperature deviating from our range showed vTrs and the safety index of delayed fracture resistance being short of the target value.

EXAMPLE 2

As with those produced in Example 1, steel plates were produced. More specifically, Steels A to Z and AA to II whose chemical compositions are shown in Tables 7 and 8 were melted and cast into slabs, and the obtained slabs were heated in a furnace and then hot-rolled to produce the steel plates. After the hot-rolling process, the steel plates were directly quenched and then tempered using solenoid type induction heating apparatus. The direct quenching was completed by forcedly cooling (cooling in water) the individual steel plates to a temperature of 350° C. or lower at a cooling rate of 1° C./s or higher.

The aspect ratios of prior austenite grains were determined in the same manner as Example 1, except that approximately 550 prior austenite grains were used to calculate the average aspect ratio.

The cementite covering ratios of lath boundaries were determined by imaging structures etched using nital with a scanning electron microscope at the position located at ¼ of the thickness of each specimen; analyzing the boundaries of approximately 60 laths in terms of the lengths of formed cementite precipitations along the lath boundaries ($L_{Cementite}$) and the lengths of the lath boundaries ($L_{Lath}$); dividing the sum of the lengths of cementite along the lath boundaries by the sum of the lengths of the lath boundaries; and then multiplying the quotient by 100.

Additionally, the yield strength, tensile strength, and safety indices of delayed fracture resistance were determined in the same manner as Example 1.

The target vTrs was set to −40° C. or lower for steels having a tensile strength less than 1200 MPa and −30° C. or lower for steels having a tensile strength of 1200 MPa or higher. On the other hand, the target safety index of delayed fracture resistance was set to 85% or higher for steels having a tensile strength less than 1200 MPa and 80% or higher for steels having a tensile strength of 1200 MPa or higher.

Tables 9 and 10 show the manufacturing conditions, aspect ratios of prior austenite grains, and cementite covering ratios of laths of the individual steel plates, and Tables 11 and 12 show the yield strength, tensile strength, fracture appearance transition temperatures (vTrs), and safety indices of delayed fracture resistance of the obtained steel plates.

It should be noted that, in Tables 9 to 12, our examples consist of steel plates meeting our requirements, whereas the comparative examples consist of those deviating from those requirements. The steel plates 1 to 17 and 41 to 47 are our examples in which the heating rate for heating from the tempering initiation temperature to 370° C. was 2° C./s or higher.

The steel plates 35 and 36 are close to our requirements, namely the requirement that the heating rate for heating from the tempering initiation temperature to 370° C. should be 2° C./s or higher and they meet others of our requirements and thus are classified into our examples.

As is clear in Tables 9 and 10, the steel plates 18 to 20, in which the rolling reduction for non-recrystallization regions deviated from our range, had the aspect ratio of prior austenite grains and cementite covering ratios of laths deviating from our ranges.

The steel plates 26 to 28 produced with the tempering temperature deviating from our range showed the cementite covering ratio of laths deviating from our range.

Furthermore, the steel plates 30 and 32 to 34 produced with the average heating rate for heating the middle of the steel thickness from the tempering initiation temperature to 370° C. and/or the average heating rate for heating the middle of the steel thickness from 370° C. to the tempering temperature deviating from our ranges showed the cementite covering ratio of laths deviating from our range.

Meanwhile, as is clear in Tables 11 and 12, the steel plates 1 to 17, 35, and 36 (our examples) were produced under manufacturing conditions falling within our range to have a chemical composition, the aspect ratio of prior austenite grains, and the cementite covering ratio of laths falling within our ranges, and showed favorable vTrs and a high safety index of delayed fracture resistance.

The comparison between the steel plates 4 and 35, both of which fall within our scope and are identical to each other except for the difference in the average heating rate for heating the middle of the steel thickness from the tempering initiation temperature to 370° C., revealed that the steel plate 4 produced with the average heating rate for heating the middle of the steel thickness from the tempering initiation temperature to 370° C. being higher than 2° C./s was better in terms of vTrs and the safety index of delayed fracture resistance than the steel plate 35. This is the case also for the comparison between the steel plates 12 and 36.

However, in the comparative steel plates 18 to 34, 37 to 46, and 48 to 52 (comparative examples), at least one of vTrs and the safety index of delayed fracture resistance deviated from the target range thereof described above. The following are specific explanations of these comparative examples.

The steel plates 37 to 40 and 48 to 52 produced with the composition deviating from our range showed vTrs and the safety index of delayed fracture resistance being short of the target value.

The steel plates 18 to 20 produced with the rolling reduction for non-crystallization regions deviating from our range showed the safety index of delayed fracture resistance being short of the target value.

The steel plates 21 to 23 produced with the direct quenching initiation temperature deviating from our range showed vTrs and/or the safety index of delayed fracture resistance being short of the target value.

The steel plates 24 and 25 produced with the direct quenching termination temperature deviating from our range showed vTrs being short of the target value.

The steel plates 26 to 28 produced with the tempering temperature deviating from our range showed vTrs and/or the safety index of delayed fracture resistance being short of the target value.

The steel plates 29 to 34 produced with the average heating rate for heating the middle of the steel thickness from 370° C. to the tempering temperature deviating from our range showed vTrs and/or the safety index of delayed fracture resistance being short of the target value.

Industrial Applicability

The steels disclosed herein are high tensile strength steels having excellent delayed fracture resistance with the tensile strength thereof being 600 MPa or higher, in particular, 900 MPa or higher, and thus has very high industrial applicability.

TABLE 1

(mass %)

| Steels | C | Si | Mn | P | S | Cu | Ni | Cr | Mo | Nb | V | Ti |
|---|---|---|---|---|---|---|---|---|---|---|---|---|
| A | 0.05 | 0.19 | 1.34 | 0.011 | 0.0019 | 0.00 | 0.00 | 0.03 | 0.05 | 0.020 | 0.034 | 0.000 |
| B | 0.08 | 0.26 | 1.43 | 0.018 | 0.0022 | 0.00 | 0.00 | 0.03 | 0.19 | 0.021 | 0.035 | 0.000 |
| C | 0.10 | 0.31 | 1.08 | 0.014 | 0.0038 | 0.00 | 0.00 | 0.06 | 0.09 | 0.019 | 0.008 | 0.010 |
| D | 0.12 | 0.38 | 1.48 | 0.014 | 0.0018 | 0.02 | 0.01 | 0.49 | 0.38 | 0.017 | 0.041 | 0.012 |
| E | 0.12 | 0.40 | 1.51 | 0.012 | 0.0019 | 0.02 | 0.01 | 0.26 | 0.40 | 0.020 | 0.000 | 0.010 |
| F | 0.13 | 0.41 | 1.51 | 0.014 | 0.0023 | 0.00 | 0.00 | 0.51 | 0.41 | 0.020 | 0.042 | 0.013 |
| G | 0.14 | 0.41 | 1.55 | 0.014 | 0.0022 | 0.00 | 1.09 | 0.50 | 0.43 | 0.020 | 0.000 | 0.011 |
| H | 0.15 | 0.41 | 1.52 | 0.014 | 0.0019 | 0.30 | 0.30 | 0.51 | 0.21 | 0.020 | 0.042 | 0.013 |
| I | 0.15 | 0.41 | 1.21 | 0.014 | 0.0037 | 0.00 | 0.00 | 0.51 | 0.69 | 0.020 | 0.000 | 0.013 |
| J | 0.16 | 0.42 | 1.19 | 0.005 | 0.0019 | 0.26 | 0.28 | 0.34 | 0.65 | 0.019 | 0.044 | 0.012 |
| K | 0.16 | 0.27 | 1.35 | 0.002 | 0.0009 | 0.26 | 0.24 | 0.53 | 0.52 | 0.022 | 0.052 | 0.013 |
| L | 0.17 | 0.37 | 1.12 | 0.009 | 0.0010 | 0.05 | 0.06 | 0.51 | 0.69 | 0.022 | 0.041 | 0.012 |
| M | 0.17 | 0.20 | 1.35 | 0.005 | 0.0018 | 0.00 | 0.40 | 0.35 | 0.25 | 0.022 | 0.050 | 0.000 |
| N | 0.17 | 0.22 | 1.45 | 0.015 | 0.0009 | 0.00 | 1.32 | 0.35 | 0.21 | 0.015 | 0.035 | 0.000 |
| O | 0.18 | 0.35 | 1.75 | 0.004 | 0.0007 | 0.20 | 0.20 | 0.45 | 0.30 | 0.019 | 0.008 | 0.010 |
| P | 0.21 | 0.33 | 1.09 | 0.014 | 0.0012 | 0.02 | 0.01 | 0.55 | 0.69 | 0.020 | 0.041 | 0.012 |

| | | | | | | | | Remarks | | |
|---|---|---|---|---|---|---|---|---|---|---|
| Steels | B | W | Ca | REM | Mg | Al | T.N | $Ar_3$ (° C.) | $Ac_1$ (° C.) | Remarks |
| A | 0.0000 | — | — | — | — | 0.031 | 0.0032 | 783 | 709 | Example |
| B | 0.0000 | — | — | — | — | 0.028 | 0.0029 | 755 | 709 | Example |
| C | 0.0010 | — | — | — | — | 0.022 | 0.0037 | 785 | 716 | Example |
| D | 0.0012 | — | 0.0017 | — | — | 0.030 | 0.0030 | 716 | 722 | Example |
| E | 0.0013 | — | — | — | — | 0.027 | 0.0031 | 715 | 717 | Example |
| F | 0.0010 | — | — | — | — | 0.032 | 0.0037 | 708 | 723 | Example |
| G | 0.0015 | — | — | — | — | 0.024 | 0.0024 | 641 | 706 | Example |
| H | 0.0010 | — | — | — | — | 0.032 | 0.0030 | 695 | 718 | Example |

TABLE 1-continued (mass %)

| | | | | | | | | | | |
|---|---|---|---|---|---|---|---|---|---|---|
| I | 0.0010 | — | — | 0.0025 | — | 0.032 | 0.0030 | 704 | 727 | Example |
| J | 0.0012 | — | — | — | 0.0015 | 0.028 | 0.0046 | 688 | 719 | Example |
| K | 0.0015 | — | 0.0032 | — | — | 0.052 | 0.0035 | 684 | 719 | Example |
| L | 0.0013 | — | 0.0019 | — | — | 0.027 | 0.0037 | 701 | 726 | Example |
| M | 0.0000 | — | — | 0.0019 | — | 0.031 | 0.0032 | 702 | 711 | Example |
| N | 0.0000 | — | — | — | — | 0.028 | 0.0029 | 647 | 697 | Example |
| O | 0.0010 | 0.20 | — | — | — | 0.022 | 0.0037 | 668 | 714 | Example |
| P | 0.0012 | — | 0.0015 | — | — | 0.030 | 0.0030 | 693 | 728 | Example |

Note 1:
The symbol * means that the parameter deviates from the range specified in the present invention.
Note 2:
$Ar_3$ = 91-310C—80Mn—20Cu—15Cr—55Ni—80Mo (the elements represent content ratios in mass percent)
Note 3:
$Ac_1$ = 723-14Mn + 22Si—14.4Ni + 23.3Cr (the elements represent content ratios in mass percent)

TABLE 2

(mass %)

| Steels | C | Si | Mn | P | S | Cu | Ni | Cr | Mo | Nb | V | Ti | B |
|---|---|---|---|---|---|---|---|---|---|---|---|---|---|
| Q | 0.23 | 0.45 | 1.52 | 0.018 | 0.0015 | 0.02 | 1.34 | 0.45 | 0.45 | 0.020 | 0.000 | 0.010 | 0.0013 |
| R | 0.12 | 0.38 | 1.48 | 0.025* | 0.0018 | 0.02 | 0.01 | 0.49 | 0.38 | 0.017 | 0.041 | 0.012 | 0.0012 |
| S | 0.14 | 0.41 | 1.55 | 0.014 | 0.0043* | 0.00 | 1.09 | 0.50 | 0.43 | 0.020 | 0.000 | 0.011 | 0.0015 |
| T | 0.15 | 0.41 | 1.52 | 0.031* | 0.0019 | 0.30 | 0.30 | 0.51 | 0.21 | 0.020 | 0.042 | 0.013 | 0.0010 |
| U | 0.17 | 0.37 | 1.12 | 0.032* | 0.0042* | 0.05 | 0.06 | 0.51 | 0.69 | 0.022 | 0.041 | 0.012 | 0.0013 |
| X | 0.03 | 0.26 | 1.31 | 0.010 | 0.0009 | 0.01 | 0.03 | 0.56 | 0.05 | 0.012 | 0.031 | 0.001 | 0.0003 |
| Y | 0.17 | 0.67 | 1.81 | 0.006 | 0.0008 | 1.98 | 3.91 | 0.63 | 0.72 | 0.018 | 0.043 | 0.012 | 0.0015 |
| Z | 0.24 | 0.32 | 1.92 | 0.003 | 0.0006 | 1.95 | 3.95 | 0.51 | 0.95 | 0.016 | 0.042 | 0.015 | 0.0013 |
| AA | 0.18 | 0.02 | 1.12 | 0.005 | 0.0003 | 1.66 | 3.81 | 0.36 | 0.86 | 0.022 | 0.045 | 0.012 | 0.0010 |
| BB | 0.20 | 0.75 | 1.08 | 0.006 | 0.0004 | 1.82 | 3.56 | 0.48 | 0.89 | 0.019 | 0.046 | 0.012 | 0.0011 |
| CC | 0.23 | 0.41 | 0.60 | 0.004 | 0.0003 | 1.91 | 3.78 | 0.39 | 0.88 | 0.021 | 0.045 | 0.010 | 0.0013 |
| DD | 0.15 | 0.42 | 1.20 | 0.006 | 0.0006 | 0.00 | 0.01 | 0.51 | 0.41 | 0.019 | 0.042 | 0.012 | 0.0012 |
| EE | 0.27* | 0.53 | 1.12 | 0.006 | 0.0004 | 1.61 | 3.23 | 0.68 | 0.78 | 0.021 | 0.043 | 0.011 | 0.0012 |
| FF | 0.22 | 0.85* | 1.08 | 0.005 | 0.0005 | 1.55 | 3.16 | 0.51 | 0.77 | 0.022 | 0.041 | 0.009 | 0.0011 |
| GG | 0.18 | 0.42 | 2.11* | 0.003 | 0.0003 | 1.51 | 2.84 | 0.53 | 0.63 | 0.021 | 0.038 | 0.011 | 0.0012 |
| HH | 0.21 | 0.51 | 1.32 | 0.004 | 0.0005 | 0.13 | 0.26 | 0.36 | 0.64 | 0.022 | 0.041 | 0.009 | 0.0011 |
| II | 0.22 | 0.48 | 1.16 | 0.005 | 0.0004 | 0.16 | 0.28 | 0.38 | 0.65 | 0.019 | 0.043 | 0.008 | 0.0012 |

| | | | | | | | Remarks | | |
|---|---|---|---|---|---|---|---|---|---|
| Steels | W | Ca | REM | Mg | Al | T.N | $Ar_3$ (° C.) | $Ac_1$ (° C.) | Remarks |
| Q | 0.15 | — | — | — | 0.027 | 0.0031 | 600 | 703 | Example |
| R | — | 0.0017 | — | — | 0.030 | 0.0030 | 716 | 722 | Comparative Example |
| S | — | — | — | — | 0.024 | 0.0024 | 641 | 706 | Comparative Example |
| T | — | — | — | — | 0.032 | 0.0030 | 695 | 718 | Comparative Example |
| U | — | 0.0019 | — | — | 0.027 | 0.0037 | 701 | 726 | Comparative Example |
| X | — | — | — | — | 0.035 | 0.0034 | 782 | 723 | Example |
| Y | — | 0.0005 | — | — | 0.031 | 0.0032 | 391 | 671 | Example |
| Z | — | 0.0012 | — | 0.0012 | 0.028 | 0.0035 | 342 | 658 | Example |
| AA | — | 0.0016 | — | — | 0.031 | 0.0034 | 448 | 661 | Example |
| BB | — | 0.0017 | — | — | 0.032 | 0.0035 | 451 | 684 | Example |
| CC | — | 0.0018 | — | — | 0.028 | 0.0033 | 468 | 678 | Example |
| DD | — | 0.0093 | — | — | 0.026 | 0.0038 | 727 | 727 | Example |
| EE | — | 0.0014 | — | — | 0.025 | 0.0034 | 454 | 688 | Comparative Example |
| FF | — | 0.0012 | — | — | 0.028 | 0.0033 | 481 | 693 | Comparative Example |
| GG | — | 0.0013 | — | — | 0.031 | 0.0034 | 441 | 674 | Comparative Example |
| HH | — | 0.0003* | — | — | 0.033 | 0.0032 | 666 | 720 | Comparative Example |
| II | — | 0.0108* | — | — | 0.031 | 0.0028 | 673 | 722 | Comparative Example |

Note 1:
The symbol * means that the parameter deviates from the range specified in the present invention.
Note 2:
$Ar_3$ = 910-310C—80Mn—20Cu—15Cr—55Ni—80Mo (the elements represent content ratios in mass percent)
Note 3:
$Ac_1$ = 723-14Mn + 22Si—14.4Ni + 23.3Cr (the elements represent content ratios in mass percent)

TABLE 3

| No. | Steels | Thickness (mm) | Heating temperature (° C.) | Rolling reduction for non-recrystallization regions (%) | Direct quenching initiation temperature (° C.) | Direct quenching termination temperature (° C.) | Cooling rate (° C./s) | Tempering initiation temperature (° C.) |
|---|---|---|---|---|---|---|---|---|
| 1 | A | 25 | 1170 | 35 | 840 | 180 | 30 | 160 |
| 2 | B | 12 | 1150 | 30 | 820 | 350 | 80 | 330 |
| 3 | C | 25 | 1130 | 55 | 840 | 320 | 30 | 300 |
| 4 | D | 12 | 1100 | 60 | 830 | 230 | 80 | 210 |
| 5 | E | 25 | 1050 | 60 | 820 | 170 | 30 | 150 |
| 6 | F | 12 | 1200 | 70 | 830 | 230 | 80 | 210 |
| 7 | G | 25 | 1100 | 60 | 830 | 130 | 30 | 110 |
| 8 | H | 50 | 1130 | 60 | 820 | 180 | 10 | 160 |
| 9 | I | 12 | 1150 | 80 | 830 | 190 | 80 | 170 |
| 10 | J | 25 | 1150 | 60 | 830 | 200 | 30 | 180 |
| 11 | K | 50 | 1130 | 60 | 850 | 90 | 10 | 70 |
| 12 | L | 60 | 1150 | 60 | 850 | 150 | 8 | 130 |
| 13 | M | 6 | 1100 | 60 | 730 | 140 | 150 | 120 |
| 14 | N | 12 | 1100 | 60 | 750 | 240 | 80 | Room temperature |
| 15 | O | 25 | 1100 | 60 | 760 | 130 | 30 | 110 |
| 16 | P | 60 | 1110 | 60 | 710 | 110 | 8 | Room temperature |
| 17 | Q | 6 | 1090 | 60 | 810 | 210 | 150 | 190 |
| 18 | A | 25 | 1170 | 25* | 840 | 180 | 30 | 160 |
| 19 | B | 12 | 1150 | 20* | 820 | 350 | 80 | 330 |
| 20 | C | 25 | 1130 | 25* | 840 | 320 | 30 | 300 |
| 21 | D | 12 | 1100 | 60 | 705* | 230 | 75 | 210 |
| 22 | E | 25 | 1050 | 60 | 700* | 170 | 25 | 150 |

| No. | Tempering temperature (° C.) | Average heating rate for heating the middle of the steel thickness from the tempering initiation temperature to the tempering temperature (° C./s) | Time for which the tempering temperature is maintained (s) | Average cooling rate for cooling from the maintained tempering temperature to 200° C. (° C./s) | Aspect ratio of prior austenite grains | Remarks |
|---|---|---|---|---|---|---|
| 1 | 540 | 0.5 | 600 | 0.3 | 3.5 | Example |
| 2 | 610 | 1.0 | 600 | 0.6 | 3.3 | Example |
| 3 | 570 | 0.5 | 600 | 0.3 | 13.2 | Example |
| 4 | 550 | 1.0 | 600 | 0.6 | 9.8 | Example |
| 5 | 590 | 0.5 | 1200 | 0.3 | 7.5 | Example |
| 6 | 640 | 1.0 | 2400 | 0.6 | 12.3 | Example |
| 7 | 680 | 0.5 | 3600 | 0.3 | 17.3 | Example |
| 8 | 600 | 0.2 | 300 | 0.2 | 6.5 | Example |
| 9 | 630 | 1.0 | 600 | 0.6 | 17.3 | Example |
| 10 | 600 | 0.5 | 600 | 0.3 | 15.3 | Example |
| 11 | 580 | 0.2 | 600 | 0.2 | 10.9 | Example |
| 12 | 550 | 0.2 | 600 | 0.1 | 5.3 | Example |
| 13 | 410 | 2.0 | 600 | 1.3 | 16.9 | Example |
| 14 | 460 | 1.0 | 60 | 0.6 | 11.9 | Example |
| 15 | 480 | 0.5 | 600 | 0.3 | 12.3 | Example |
| 16 | 510 | 0.2 | 600 | 0.1 | 5.4 | Example |
| 17 | 430 | 2.0 | 600 | 1.3 | 17.9 | Example |
| 18 | 540 | 0.5 | 600 | 0.3 | 2.5* | Comparative Example |
| 19 | 610 | 1.0 | 600 | 0.6 | 2.3* | Comparative Example |
| 20 | 570 | 0.5 | 600 | 0.3 | 1.7* | Comparative Example |
| 21 | 550 | 1.0 | 600 | 0.6 | 9.8 | Comparative Example |
| 22 | 590 | 0.5 | 1200 | 0.3 | 7.5 | Comparative Example |

Note 1:

The symbol * means that the parameter deviates from the range specified in the present invention.

Note 2:

Ranges specified in the present invention are as follows: rolling reduction for non-recrystallization regions: 30% or higher; direct quenching initiation temperature: $Ar_3$ transformation temperature or higher; direct quenching termination temperature: 350° C. or lower; cooling rate: 1° C./s or higher; tempering temperature: $Ac_1$ transformation temperature or lower

TABLE 4

| No. | Steels | Thickness (mm) | Heating temperature (° C.) | Rolling reduction for non-recrystallization regions (%) | Direct quenching initiation temperature (° C.) | Direct quenching termination temperature (° C.) | Cooling rate (° C./s) | Tempering initiation temperature (° C.) |
|---|---|---|---|---|---|---|---|---|
| 23 | F | 12 | 1200 | 70 | 690* | 230 | 75 | 210 |
| 24 | G | 25 | 1100 | 60 | 830 | 400* | 35 | 110 |
| 25 | H | 50 | 1130 | 60 | 820 | 450* | 0.8* | 160 |
| 26 | I | 12 | 1150 | 80 | 830 | 190 | 80 | 170 |
| 27 | J | 25 | 1150 | 60 | 830 | 200 | 30 | 180 |
| 28 | K | 50 | 1130 | 60 | 850 | 90 | 10 | 70 |
| 29 | R* | 35 | 1100 | 60 | 830 | 200 | 15 | 180 |
| 30 | S* | 50 | 1050 | 60 | 850 | 150 | 10 | 130 |
| 31 | T* | 50 | 1050 | 60 | 850 | 150 | 10 | 130 |
| 32 | U* | 60 | 1200 | 60 | 850 | 150 | 8 | 130 |
| 33 | X | 25 | 1160 | 30 | 830 | 230 | 30 | 210 |
| 34 | Y | 6 | 1120 | 65 | 670 | 80 | 150 | 60 |
| 35 | Z | 25 | 1110 | 75 | 640 | 100 | 30 | 80 |
| 36 | AA | 12 | 1120 | 70 | 650 | 120 | 80 | 100 |
| 37 | BB | 32 | 1130 | 75 | 720 | 100 | 18 | 80 |
| 38 | CC | 20 | 1150 | 70 | 680 | 100 | 50 | 80 |
| 39 | DD | 32 | 1100 | 60 | 830 | 230 | 18 | 210 |
| 40 | EE* | 16 | 1100 | 75 | 700 | 100 | 60 | 80 |
| 41 | FF* | 8 | 1110 | 70 | 680 | 100 | 120 | 80 |
| 42 | GG* | 12 | 1120 | 60 | 670 | 100 | 80 | 80 |
| 43 | HH* | 12 | 1120 | 60 | 830 | 200 | 80 | 180 |
| 44 | II* | 12 | 1120 | 60 | 830 | 200 | 80 | 180 |

| No. | Tempering temperature (° C.) | Average heating rate for heating the middle of the steel thickness from the tempering initiation temperature to the tempering temperature (° C./s) | Time for which the tempering temperature is maintained (s) | Average cooling rate for cooling from the maintained tempering temperature to 200° C. (° C./s) | Aspect ratio of prior austenite grains | Remarks |
|---|---|---|---|---|---|---|
| 23 | 640 | 1.0 | 2400 | 0.6 | 12.3 | Comparative Example |
| 24 | 680 | 0.5 | 3600 | 0.3 | 17.3 | Comparative Example |
| 25 | 600 | 0.2 | 300 | 0.2 | 6.5 | Comparative Example |
| 26 | 740* | 1.0 | 600 | 0.6 | 17.3 | Comparative Example |
| 27 | 730* | 0.5 | 600 | 0.3 | 15.3 | Comparative Example |
| 28 | 730* | 0.2 | 600 | 0.2 | 10.9 | Comparative Example |
| 29 | 490 | 0.3 | 600 | 0.2 | 10.7 | Comparative Example |
| 30 | 520 | 0.2 | 600 | 0.2 | 4.9 | Comparative Example |
| 31 | 520 | 0.2 | 600 | 0.2 | 5.5 | Comparative Example |
| 32 | 500 | 0.2 | 600 | 0.1 | 6.3 | Comparative Example |
| 33 | 520 | 0.5 | 10 | 0.3 | 3.5 | Example |
| 34 | 500 | 2.0 | 10 | 1.3 | 12.5 | Example |
| 35 | 500 | 0.5 | 10 | 0.3 | 16.1 | Example |
| 36 | 520 | 1.0 | 10 | 0.6 | 14.1 | Example |
| 37 | 500 | 0.4 | 10 | 0.2 | 16.3 | Example |
| 38 | 520 | 0.6 | 60 | 0.4 | 14.5 | Example |
| 39 | 560 | 0.4 | 600 | 0.2 | 8.3 | Example |
| 40 | 520 | 0.8 | 10 | 0.5 | 16.7 | Comparative Example |
| 41 | 520 | 1.5 | 10 | 0.9 | 17.6 | Comparative Example |
| 42 | 500 | 1.0 | 10 | 0.6 | 6.5 | Comparative Example |
| 43 | 500 | 1.0 | 10 | 0.6 | 6.3 | Comparative Example |
| 44 | 500 | 1.0 | 10 | 0.6 | 6.5 | Comparative Example |

Note 1:

The symbol * means that the parameter deviates from the range specified in the present invention.

Note 2:

Ranges specified in the present invention are as follows: rolling reduction for non-recrystallization regions: 30% or higher; direct quenching initiation temperature: $Ar_3$ transformation temperature or higher; direct quenching termination temperature: 350° C. or lower; cooling rate: 1° C./s or higher; tempering temperature: $Ac_1$ transformation temperature or lower

TABLE 5

| No. | Steels | Thickness (mm) | Yield strength (MPa) | Tensile strength (MPa) | vTrs at the middle of the steel thickness (° C.) | Safety index of delayed fracture resistance (%) | Remarks |
|---|---|---|---|---|---|---|---|
| 1 | A | 25 | 573 | 648 | −105 | 93 | Example |
| 2 | B | 12 | 601 | 678 | −116 | 89 | Example |
| 3 | C | 25 | 801 | 868 | −78 | 91 | Example |
| 4 | D | 12 | 1023 | 1048 | −68 | 89 | Example |

TABLE 5-continued

| No. | Steels | Thickness (mm) | Yield strength (MPa) | Tensile strength (MPa) | vTrs at the middle of the steel thickness (° C.) | Safety index of delayed fracture resistance (%) | Remarks |
|---|---|---|---|---|---|---|---|
| 5 | E | 25 | 1006 | 1027 | −69 | 85 | Example |
| 6 | F | 12 | 1056 | 1061 | −59 | 83 | Example |
| 7 | G | 25 | 1013 | 1052 | −59 | 85 | Example |
| 8 | H | 50 | 1014 | 1019 | −52 | 84 | Example |
| 9 | I | 12 | 1083 | 1197 | −42 | 81 | Example |
| 10 | J | 25 | 1197 | 1247 | −42 | 85 | Example |
| 11 | K | 50 | 1232 | 1267 | −41 | 79 | Example |
| 12 | L | 60 | 1017 | 1057 | −48 | 86 | Example |
| 13 | M | 6 | 1257 | 1263 | −49 | 80 | Example |
| 14 | N | 12 | 1357 | 1376 | −41 | 79 | Example |
| 15 | O | 25 | 1327 | 1387 | −39 | 78 | Example |
| 16 | P | 60 | 1287 | 1298 | −36 | 79 | Example |
| 17 | Q | 6 | 1356 | 1387 | −35 | 78 | Example |
| 18 | A | 25 | 476 | 553 | −42 | 46* | Comparative Example |
| 19 | B | 12 | 529 | 607 | −58 | 42* | Comparative Example |
| 20 | C | 25 | 815 | 823 | −59 | 38* | Comparative Example |
| 21 | D | 12 | 831 | 867 | −29* | 66* | Comparative Example |
| 22 | E | 25 | 923 | 941 | −31* | 59* | Comparative Example |

Note 1:

The symbol * means that the parameter deviates from the range specified in the present invention.

Note 2:

Ranges specified in the present invention are as follows: 1. vTrs at the middle of the steel thickness (° C.): −40° C. or lower for steel plates with a tensile strength lower than 1200 MPa; −30° C. or lower for steel plates with a tensile strength of 1200 MPa or higher: 2. Safety index of delayed fracture resistance: 80% or higher for steel plates with a tensile strength lower than 1200 MPa; 75% or higher for steel plates with a tensile strength of 1200 MPa or higher

TABLE 6

| No. | Steels | Thickness (mm) | Yield strength (MPa) | Tensile strength (MPa) | vTrs at the middle of the steel thickness (° C.) | Safety index of delayed fracture resistance (%) | Remarks |
|---|---|---|---|---|---|---|---|
| 23 | F | 12 | 982 | 991 | −38* | 52* | Comparative Example |
| 24 | G | 25 | 923 | 956 | −31* | 78* | Comparative Example |
| 25 | H | 50 | 937 | 952 | −27* | 76* | Comparative Example |
| 26 | I | 12 | 983 | 1063 | −27* | 68* | Comparative Example |
| 27 | J | 25 | 1101 | 1157 | −29* | 62* | Comparative Example |
| 28 | K | 50 | 1127 | 1151 | −27* | 53* | Comparative Example |
| 29 | R* | 35 | 1017 | 1041 | −31* | 43* | Comparative Example |
| 30 | S* | 50 | 1007 | 1047 | −27* | 42* | Comparative Example |
| 31 | T* | 50 | 1009 | 1012 | −23* | 36* | Comparative Example |
| 32 | U* | 60 | 1021 | 1061 | −15* | 39* | Comparative Example |
| 33 | X | 25 | 562 | 627 | −102 | 96 | Example |
| 34 | Y | 6 | 1380 | 1457 | −42 | 78 | Example |
| 35 | Z | 25 | 1421 | 1512 | −46 | 77 | Example |
| 36 | AA | 12 | 1358 | 1583 | −48 | 80 | Example |
| 37 | BB | 32 | 1391 | 1623 | −42 | 79 | Example |
| 38 | CC | 20 | 1413 | 1678 | −43 | 81 | Example |
| 39 | DD | 32 | 1071 | 1112 | −63 | 88 | Example |
| 40 | EE* | 16 | 1378 | 1563 | −26* | 56* | Comparative Example |
| 41 | FF* | 8 | 1341 | 1532 | −25* | 63* | Comparative Example |
| 42 | GG* | 12 | 1328 | 1419 | −23* | 65* | Comparative Example |
| 43 | HH* | 12 | 1151 | 1238 | −41 | 68* | Comparative Example |
| 44 | II* | 12 | 1168 | 1241 | −28* | 53* | Comparative Example |

Note 1:

The symbol * means that the parameter deviates from the range specified in the present invention.

Note 2:

Ranges specified in the present invention are as follows: 1. vTrs at the middle of the steel thickness (° C.): −40° C. or lower for steel plates with a tensile strength lower than 1200 MPa; −30° C. or lower for steel plates with a tensile strength of 1200 MPa or higher: 2. Safety index of delayed fracture resistance: 80% or higher for steel plates with a tensile strength lower than 1200 MPa; 75% or higher for steel plates with a tensile strength of 1200 MPa or higher

TABLE 7

(mass %)

| Steels | C | Si | Mn | P | S | Cu | Ni | Cr | Mo | Nb | V | Ti |
|---|---|---|---|---|---|---|---|---|---|---|---|---|
| A | 0.05 | 0.19 | 1.34 | 0.011 | 0.0019 | 0.00 | 0.00 | 0.03 | 0.05 | 0.020 | 0.034 | 0.000 |
| B | 0.08 | 0.26 | 1.43 | 0.018 | 0.0022 | 0.00 | 0.00 | 0.03 | 0.19 | 0.021 | 0.035 | 0.000 |
| C | 0.10 | 0.31 | 1.08 | 0.014 | 0.0029 | 0.00 | 0.00 | 0.06 | 0.09 | 0.019 | 0.008 | 0.010 |
| D | 0.12 | 0.38 | 1.48 | 0.014 | 0.0018 | 0.02 | 0.01 | 0.49 | 0.38 | 0.017 | 0.041 | 0.012 |
| E | 0.12 | 0.40 | 1.51 | 0.012 | 0.0019 | 0.02 | 0.01 | 0.26 | 0.40 | 0.020 | 0.000 | 0.010 |
| F | 0.13 | 0.41 | 1.51 | 0.014 | 0.0023 | 0.00 | 0.00 | 0.51 | 0.41 | 0.020 | 0.042 | 0.013 |
| G | 0.14 | 0.41 | 1.55 | 0.014 | 0.0022 | 0.00 | 1.09 | 0.50 | 0.43 | 0.020 | 0.000 | 0.011 |

TABLE 7-continued (mass %)

| | | | | | | | | | | | | |
|---|---|---|---|---|---|---|---|---|---|---|---|---|
| H | 0.15 | 0.41 | 1.52 | 0.014 | 0.0019 | 0.30 | 0.30 | 0.51 | 0.21 | 0.020 | 0.042 | 0.013 |
| I | 0.15 | 0.41 | 1.21 | 0.014 | 0.0027 | 0.00 | 0.00 | 0.51 | 0.69 | 0.020 | 0.000 | 0.013 |
| J | 0.16 | 0.42 | 1.19 | 0.005 | 0.0019 | 0.26 | 0.28 | 0.34 | 0.65 | 0.019 | 0.044 | 0.012 |
| K | 0.16 | 0.27 | 1.35 | 0.002 | 0.0009 | 0.26 | 0.24 | 0.53 | 0.52 | 0.022 | 0.052 | 0.013 |
| L | 0.17 | 0.37 | 1.12 | 0.009 | 0.0010 | 0.05 | 0.06 | 0.51 | 0.69 | 0.022 | 0.041 | 0.012 |
| M | 0.17 | 0.20 | 1.35 | 0.005 | 0.0018 | 0.00 | 0.40 | 0.35 | 0.25 | 0.022 | 0.050 | 0.000 |
| N | 0.17 | 0.22 | 1.45 | 0.015 | 0.0009 | 0.00 | 1.32 | 0.35 | 0.21 | 0.015 | 0.035 | 0.000 |
| O | 0.18 | 0.35 | 1.75 | 0.004 | 0.0007 | 0.20 | 0.20 | 0.45 | 0.30 | 0.019 | 0.008 | 0.010 |
| P | 0.21 | 0.33 | 1.09 | 0.014 | 0.0012 | 0.02 | 0.01 | 0.55 | 0.69 | 0.020 | 0.041 | 0.012 |

| Steels | B | W | Ca | REM | Mg | Al | T.N | Remarks $Ar_3$ (° C.) | Remarks $Ac_1$ (° C.) |
|---|---|---|---|---|---|---|---|---|---|
| A | 0.0000 | — | — | — | — | 0.031 | 0.0032 | 783 | 709 |
| B | 0.0000 | — | — | — | — | 0.028 | 0.0029 | 755 | 709 |
| C | 0.0010 | — | — | — | — | 0.022 | 0.0037 | 785 | 716 |
| D | 0.0012 | — | 0.0017 | — | — | 0.030 | 0.0030 | 716 | 722 |
| E | 0.0013 | — | — | — | — | 0.027 | 0.0031 | 715 | 717 |
| F | 0.0010 | — | — | — | — | 0.032 | 0.0037 | 708 | 723 |
| G | 0.0015 | — | — | — | — | 0.024 | 0.0024 | 641 | 706 |
| H | 0.0010 | — | — | — | — | 0.032 | 0.0030 | 695 | 718 |
| I | 0.0010 | — | — | 0.0025 | — | 0.032 | 0.0030 | 704 | 727 |
| J | 0.0012 | — | — | — | 0.0015 | 0.028 | 0.0046 | 688 | 719 |
| K | 0.0015 | — | 0.0032 | — | — | 0.052 | 0.0035 | 684 | 719 |
| L | 0.0013 | — | 0.0019 | — | — | 0.027 | 0.0037 | 701 | 726 |
| M | 0.0000 | — | — | 0.0019 | — | 0.031 | 0.0032 | 702 | 711 |
| N | 0.0000 | — | — | — | — | 0.028 | 0.0029 | 647 | 697 |
| O | 0.0010 | 0.20 | — | — | — | 0.022 | 0.0037 | 668 | 714 |
| P | 0.0012 | — | 0.0015 | — | — | 0.030 | 0.0030 | 693 | 728 |

Note 1:

The symbol * means that the parameter deviates from the range specified in the present invention.

Note 2:

$Ar_3$ (° C.) = 910-310C—80Mn—20Cu—15Cr—55Ni—80Mo

Note 3:

$Ac_1$ (° C.) = 723-14Mn + 22Si—14.4Ni + 23.3Cr

TABLE 8

(mass %)

| Steels | C | Si | Mn | P | S | Cu | Ni | Cr | Mo | Nb | V | Ti |
|---|---|---|---|---|---|---|---|---|---|---|---|---|
| Q | 0.23 | 0.45 | 1.52 | 0.018 | 0.0015 | 0.02 | 1.34 | 0.45 | 0.45 | 0.020 | 0.000 | 0.010 |
| R | 0.12 | 0.38 | 1.48 | 0.025* | 0.0018 | 0.02 | 0.01 | 0.49 | 0.38 | 0.017 | 0.041 | 0.012 |
| S | 0.14 | 0.41 | 1.55 | 0.014 | 0.0043* | 0.00 | 1.09 | 0.50 | 0.43 | 0.020 | 0.000 | 0.011 |
| T | 0.15 | 0.41 | 1.52 | 0.031* | 0.0019 | 0.30 | 0.30 | 0.51 | 0.21 | 0.020 | 0.042 | 0.013 |
| U | 0.17 | 0.37 | 1.12 | 0.032* | 0.0042* | 0.05 | 0.06 | 0.51 | 0.69 | 0.022 | 0.041 | 0.012 |
| X | 0.03 | 0.26 | 1.31 | 0.010 | 0.0009 | 0.01 | 0.03 | 0.56 | 0.05 | 0.012 | 0.031 | 0.001 |
| Y | 0.17 | 0.67 | 1.81 | 0.006 | 0.0008 | 1.98 | 3.91 | 0.63 | 0.72 | 0.018 | 0.043 | 0.012 |
| Z | 0.24 | 0.32 | 1.92 | 0.003 | 0.0006 | 1.95 | 3.95 | 0.51 | 0.95 | 0.016 | 0.042 | 0.015 |
| AA | 0.18 | 0.02 | 1.12 | 0.005 | 0.0003 | 1.66 | 3.81 | 0.36 | 0.86 | 0.022 | 0.045 | 0.012 |
| BB | 0.20 | 0.75 | 1.08 | 0.006 | 0.0004 | 1.82 | 3.56 | 0.48 | 0.89 | 0.019 | 0.046 | 0.012 |
| CC | 0.23 | 0.41 | 0.60 | 0.004 | 0.0003 | 1.91 | 3.78 | 0.39 | 0.88 | 0.021 | 0.045 | 0.010 |
| DD | 0.15 | 0.42 | 1.20 | 0.006 | 0.0006 | 0.00 | 0.01 | 0.51 | 0.41 | 0.019 | 0.042 | 0.012 |
| EE | 0.27* | 0.53 | 1.12 | 0.006 | 0.0004 | 1.61 | 3.23 | 0.68 | 0.78 | 0.021 | 0.043 | 0.011 |
| FF | 0.22 | 0.85* | 1.08 | 0.005 | 0.0005 | 1.55 | 3.16 | 0.51 | 0.77 | 0.022 | 0.041 | 0.009 |
| GG | 0.18 | 0.42 | 2.11* | 0.003 | 0.0003 | 1.51 | 2.84 | 0.53 | 0.63 | 0.021 | 0.038 | 0.011 |
| HH | 0.21 | 0.51 | 1.32 | 0.004 | 0.0005 | 0.13 | 0.26 | 0.36 | 0.64 | 0.022 | 0.041 | 0.009 |
| II | 0.22 | 0.48 | 1.16 | 0.005 | 0.0004 | 0.16 | 0.28 | 0.38 | 0.65 | 0.019 | 0.043 | 0.008 |

| Steels | B | W | Ca | REM | Mg | Al | T.N | Remarks $Ar_3$ (° C.) | Remarks $Ac_1$ (° C.) |
|---|---|---|---|---|---|---|---|---|---|
| Q | 0.0013 | 0.15 | — | — | — | 0.027 | 0.0031 | 600 | 703 |
| R | 0.0012 | — | 0.0017 | — | — | 0.030 | 0.0030 | 716 | 722 |
| S | 0.0015 | — | — | — | — | 0.024 | 0.0024 | 641 | 706 |
| T | 0.0010 | — | — | — | — | 0.032 | 0.0030 | 695 | 718 |
| U | 0.0013 | — | 0.0019 | — | — | 0.027 | 0.0037 | 701 | 726 |
| X | 0.0003 | — | — | — | — | 0.035 | 0.0034 | 782 | 723 |
| Y | 0.0015 | — | 0.0005 | — | — | 0.031 | 0.0032 | 391 | 671 |
| Z | 0.0013 | — | 0.0012 | — | 0.0012 | 0.028 | 0.0035 | 342 | 658 |
| AA | 0.0010 | — | 0.0016 | — | — | 0.031 | 0.0034 | 448 | 661 |
| BB | 0.0011 | — | 0.0017 | — | — | 0.032 | 0.0035 | 451 | 684 |

TABLE 8-continued (mass %)

| | | | | | | | | | |
|---|---|---|---|---|---|---|---|---|---|
| CC | 0.0013 | — | 0.0018 | — | — | 0.028 | 0.0033 | 468 | 678 |
| DD | 0.0012 | — | 0.0093 | — | — | 0.026 | 0.0038 | 727 | 727 |
| EE | 0.0012 | — | 0.0014 | — | — | 0.025 | 0.0034 | 454 | 688 |
| FF | 0.0011 | — | 0.0012 | — | — | 0.028 | 0.0033 | 481 | 693 |
| GG | 0.0012 | — | 0.0013 | — | — | 0.031 | 0.0034 | 441 | 674 |
| HH | 0.0011 | — | 0.0003* | — | — | 0.033 | 0.0032 | 666 | 720 |
| II | 0.0012 | — | 0.0108* | — | — | 0.031 | 0.0028 | 673 | 722 |

Note 1:

The symbol * means that the parameter deviates from the range specified in the present invention.

Note 2:

$Ar_3$ (° C.) = 910-310C—80Mn—20Cu—15Cr—55Ni—80Mo

Note 3:

$Ac_1$ (° C.) = 723-14Mn + 22Si—14.4Ni + 23.3Cr

TABLE 9

| No. | Steels | Thickness (mm) | Heating temperature (° C.) | Rolling reduction for non-recrystallization regions (%) | Direct quenching initiation temperature (° C.) | Direct quenching termination temperature (° C.) | Tempering initiation temperature (° C.) | Tempering temperature (° C.) |
|---|---|---|---|---|---|---|---|---|
| 1 | A | 25 | 1170 | 35 | 840 | 180 | 160 | 540 |
| 2 | B | 12 | 1150 | 30 | 820 | 350 | 330 | 610 |
| 3 | C | 25 | 1130 | 55 | 840 | 320 | 300 | 570 |
| 4 | D | 12 | 1100 | 60 | 830 | 230 | 210 | 550 |
| 5 | E | 25 | 1050 | 60 | 820 | 170 | 150 | 590 |
| 6 | F | 12 | 1200 | 70 | 830 | 230 | 210 | 640 |
| 7 | G | 25 | 1100 | 60 | 830 | 130 | 110 | 680 |
| 8 | H | 50 | 1130 | 60 | 820 | 180 | 160 | 600 |
| 9 | I | 12 | 1150 | 80 | 830 | 190 | 170 | 630 |
| 10 | J | 25 | 1150 | 60 | 830 | 200 | 180 | 600 |
| 11 | K | 50 | 1130 | 60 | 850 | 90 | 70 | 580 |
| 12 | L | 60 | 1150 | 60 | 850 | 150 | 130 | 550 |
| 13 | M | 6 | 1100 | 60 | 730 | 140 | 120 | 410 |
| 14 | N | 12 | 1100 | 60 | 750 | 240 | Room temperature | 460 |
| 15 | O | 25 | 1100 | 60 | 760 | 130 | 110 | 480 |
| 16 | P | 60 | 1110 | 60 | 710 | 110 | Room temperature | 510 |
| 17 | Q | 6 | 1090 | 60 | 810 | 210 | 190 | 430 |
| 18 | A | 25 | 1170 | 25* | 840 | 180 | 160 | 540 |
| 19 | B | 12 | 1150 | 20* | 820 | 350 | 330 | 610 |
| 20 | C | 25 | 1130 | 25* | 840 | 320 | 300 | 570 |
| 21 | D | 12 | 1100 | 60 | 705* | 230 | 210 | 550 |
| 22 | E | 25 | 1050 | 60 | 700* | 170 | 150 | 590 |
| 23 | F | 12 | 1200 | 70 | 690* | 230 | 210 | 640 |
| 24 | G | 25 | 1100 | 60 | 830 | 400* | 110 | 680 |
| 25 | H | 50 | 1130 | 60 | 820 | 450* | 160 | 600 |
| 26 | I | 12 | 1150 | 80 | 830 | 190 | 170 | 740* |

| No. | Average heating rate for heating the middle of the steel thickness from the tempering initiation temperature to 370° C. (° C./s) | Average heating rate for heating the middle of the steel thickness from 370° C. to the tempering temperature (° C./s) | Time for which the tempering temperature is maintained (s) | Average cooling rate for cooling from the maintained tempering temperature to 200° C. (° C./s) | Aspect ratio of prior austenite grains | Cementite covering rate of laths | Classification |
|---|---|---|---|---|---|---|---|
| 1 | 6.0 | 8.0 | 0 | 0.3 | 3.5 | 5 | Example |
| 2 | 12.5 | 14.5 | 0 | 0.6 | 3.3 | 7 | Example |
| 3 | 6.0 | 8.0 | 0 | 0.3 | 13.2 | 12 | Example |
| 4 | 12.5 | 14.5 | 0 | 0.6 | 9.8 | 15 | Example |
| 5 | 6.0 | 8.0 | 0 | 0.3 | 7.5 | 24 | Example |
| 6 | 12.5 | 14.5 | 0 | 0.6 | 12.3 | 34 | Example |
| 7 | 6.0 | 8.0 | 0 | 0.3 | 17.3 | 40 | Example |
| 8 | 3.0 | 5.0 | 60 | 0.2 | 6.5 | 26 | Example |
| 9 | 12.5 | 14.5 | 0 | 0.6 | 17.3 | 25 | Example |
| 10 | 6.0 | 8.0 | 0 | 0.3 | 15.3 | 30 | Example |
| 11 | 3.0 | 5.0 | 60 | 0.2 | 10.9 | 26 | Example |
| 12 | 2.5 | 4.5 | 0 | 0.1 | 5.3 | 19 | Example |
| 13 | 25.0 | 27.0 | 0 | 1.3 | 16.9 | 11 | Example |
| 14 | 12.5 | 14.5 | 0 | 0.6 | 11.9 | 23 | Example |
| 15 | 6.0 | 8.0 | 0 | 0.3 | 12.3 | 37 | Example |

TABLE 9-continued

| | | | | | | | |
|---|---|---|---|---|---|---|---|
| 16 | 2.5 | 4.5 | 0 | 0.1 | 5.4 | 40 | Example |
| 17 | 25.0 | 27.0 | 0 | 1.3 | 17.9 | 35 | Example |
| 18 | 6.0 | 8.0 | 0 | 0.3 | 2.5* | 55* | Comparative Example |
| 19 | 12.5 | 14.5 | 0 | 0.6 | 2.3* | 52* | Comparative Example |
| 20 | 6.0 | 8.0 | 0 | 0.3 | 1.7* | 53* | Comparative Example |
| 21 | 12.5 | 14.5 | 0 | 0.6 | 8.8 | 14 | Comparative Example |
| 22 | 6.0 | 8.0 | 0 | 0.3 | 7.1 | 23 | Comparative Example |
| 23 | 12.5 | 14.5 | 0 | 0.6 | 11.2 | 32 | Comparative Example |
| 24 | 6.0 | 8.0 | 0 | 0.3 | 16.6 | 38 | Comparative Example |
| 25 | 3.0 | 5.0 | 60 | 0.2 | 6.2 | 24 | Comparative Example |
| 26 | 12.5 | 14.5 | 0 | 0.6 | 17.0 | 56* | Comparative Example |

Note:
The symbol * means that the parameter deviates from the range specified in the present invention.

TABLE 10

| No. | Steels | Thickness (mm) | Heating temperature (° C.) | Rolling reduction for non-recrystallization regions (%) | Direct quenching initiation temperature (° C.) | Direct quenching termination temperature (° C.) | Tempering initiation temperature (° C.) | Tempering temperature (° C.) |
|---|---|---|---|---|---|---|---|---|
| 27 | J | 25 | 1150 | 60 | 830 | 200 | 180 | 730* |
| 28 | K | 50 | 1130 | 60 | 850 | 90 | 70 | 730* |
| 29 | L | 60 | 1150 | 60 | 850 | 150 | 130 | 550 |
| 30 | M | 6 | 1100 | 60 | 730 | 140 | 120 | 410 |
| 31 | N | 12 | 1100 | 60 | 750 | 240 | Room temperature | 460 |
| 32 | O | 25 | 1100 | 60 | 760 | 130 | 110 | 480 |
| 33 | P | 60 | 1110 | 60 | 710 | 110 | Room temperature | 510 |
| 34 | Q | 6 | 1090 | 60 | 810 | 210 | 190 | 430 |
| 35 | D | 12 | 1100 | 60 | 830 | 230 | 210 | 550 |
| 36 | L | 60 | 1150 | 60 | 850 | 150 | 130 | 550 |
| 37 | R | 35 | 1100 | 60 | 830 | 200 | 180 | 490 |
| 38 | S | 50 | 1050 | 60 | 850 | 150 | 130 | 520 |
| 39 | T | 50 | 1050 | 60 | 850 | 150 | 130 | 520 |
| 40 | U | 60 | 1200 | 60 | 850 | 150 | 130 | 500 |
| 41 | X | 25 | 1160 | 30 | 830 | 230 | 810 | 520 |
| 42 | Y | 6 | 1120 | 65 | 670 | 80 | 850 | 500 |
| 43 | Z | 25 | 1110 | 75 | 640 | 100 | 620 | 500 |
| 44 | AA | 12 | 1120 | 70 | 650 | 120 | 630 | 520 |
| 45 | BB | 32 | 1130 | 75 | 720 | 100 | 700 | 500 |
| 46 | CC | 20 | 1150 | 70 | 680 | 100 | 660 | 520 |
| 47 | DD | 32 | 1100 | 60 | 830 | 230 | 810 | 560 |
| 48 | EE | 16 | 1100 | 75 | 700 | 100 | 680 | 520 |
| 49 | FF | 8 | 1110 | 70 | 680 | 100 | 660 | 520 |
| 50 | GG | 12 | 1120 | 60 | 670 | 100 | 650 | 500 |
| 51 | HH | 12 | 1120 | 60 | 830 | 200 | 810 | 500 |
| 52 | II | 12 | 1120 | 60 | 830 | 200 | 810 | 500 |

| No. | Average heating rate for heating the middle of the steel thickness from the tempering initiation temperature to 370° C. (° C./s) | Average heating rate for heating the middle of the steel thickness from 370° C. to the tempering temperature (° C./s) | Time for which the tempering temperature is maintained (s) | Average cooling rate for cooling from the maintained tempering temperature to 200° C. (° C./s) | Aspect ratio of prior austenite grains | Cementite covering rate of laths | Classification |
|---|---|---|---|---|---|---|---|
| 27 | 6.0 | 8.0 | 0 | 0.3 | 15.1 | 61* | Comparative Example |
| 28 | 3.0 | 5.0 | 60 | 0.2 | 10.2 | 63* | Comparative Example |
| 29 | 2.5 | 0.8* | 0 | 0.1 | 5.3 | 39 | Comparative Example |
| 30 | 25.0 | 0.9* | 0 | 1.3 | 16.9 | 52* | Comparative Example |
| 31 | 12.5 | 0.7* | 0 | 0.6 | 11.9 | 42 | Comparative Example |
| 32 | 1.5 | 0.6* | 0 | 0.3 | 12.3 | 55* | Comparative Example |
| 33 | 1.1 | 0.6* | 0 | 0.1 | 5.4 | 61* | Comparative Example |
| 34 | 1.2 | 0.8* | 0 | 1.3 | 17.9 | 53* | Comparative Example |
| 35 | 1.5 | 14.5 | 0 | 0.6 | 9.8 | 23 | Example |
| 36 | 1.0 | 4.5 | 0 | 0.1 | 5.3 | 32 | Example |
| 37 | 4.3 | 6.3 | 0 | 0.2 | 10.7 | 41 | Comparative Example |
| 38 | 3.0 | 5.0 | 0 | 0.2 | 4.9 | 45 | Comparative Example |
| 39 | 3.0 | 5.0 | 0 | 0.2 | 5.5 | 23 | Comparative Example |
| 40 | 2.5 | 4.5 | 0 | 0.1 | 6.3 | 56* | Comparative Example |
| 41 | 5.0 | 7.0 | 10 | 0.3 | 3.5 | 25 | Example |
| 42 | 20.0 | 22.0 | 0 | 1.3 | 12.5 | 21 | Example |

TABLE 10-continued

| | | | | | | | |
|---|---|---|---|---|---|---|---|
| 43 | 5.0 | 7.0 | 10 | 0.3 | 16.1 | 25 | Example |
| 44 | 10.0 | 12.0 | 10 | 0.6 | 14.1 | 21 | Example |
| 45 | 3.0 | 5.0 | 0 | 0.2 | 16.3 | 32 | Example |
| 46 | 5.0 | 7.0 | 0 | 0.4 | 14.5 | 26 | Example |
| 47 | 3.0 | 5.0 | 0 | 0.2 | 8.3 | 31 | Example |
| 48 | 8.0 | 10.0 | 0 | 0.5 | 16.7 | 34 | Comparative Example |
| 49 | 15.0 | 17.0 | 0 | 0.9 | 17.6 | 19 | Comparative Example |
| 50 | 10.0 | 12.0 | 0 | 0.6 | 6.5 | 32 | Comparative Example |
| 51 | 10.0 | 12.0 | 0 | 0.6 | 6.3 | 23 | Comparative Example |
| 52 | 10.0 | 12.0 | 10 | 0.6 | 6.5 | 26 | Comparative Example |

Note:
The symbol * means that the parameter deviates from the range specified in the present invention.

TABLE 11

| No. | Steels | Thickness (mm) | Yield strength (MPa) | Tensile strength (MPa) | vTrs at the middle of the steel thickness (° C.) | Safety index of delayed fracture resistance (%) | Classification |
|---|---|---|---|---|---|---|---|
| 1 | A | 25 | 596 | 667 | −121 | 100 | Example |
| 2 | B | 12 | 611 | 695 | −131 | 99 | Example |
| 3 | C | 25 | 812 | 888 | −93 | 100 | Example |
| 4 | D | 12 | 1037 | 1061 | −81 | 98 | Example |
| 5 | E | 25 | 1015 | 1041 | −83 | 99 | Example |
| 6 | F | 12 | 1112 | 1115 | −73 | 97 | Example |
| 7 | G | 25 | 1069 | 1100 | −76 | 97 | Example |
| 8 | H | 50 | 1025 | 1034 | −63 | 96 | Example |
| 9 | I | 12 | 1151 | 1253 | −53 | 95 | Example |
| 10 | J | 25 | 1251 | 1314 | −51 | 90 | Example |
| 11 | K | 50 | 1296 | 1312 | −49 | 91 | Example |
| 12 | L | 60 | 1051 | 1097 | −56 | 98 | Example |
| 13 | M | 6 | 1315 | 1317 | −66 | 89 | Example |
| 14 | N | 12 | 1410 | 1426 | −56 | 88 | Example |
| 15 | O | 25 | 1399 | 1415 | −49 | 89 | Example |
| 16 | P | 60 | 1333 | 1348 | −41 | 85 | Example |
| 17 | Q | 6 | 1410 | 1451 | −66 | 82 | Example |
| 18 | A | 25 | 523 | 601 | −59 | 53* | Comparative Example |
| 19 | B | 12 | 538 | 623 | −63 | 49* | Comparative Example |
| 20 | C | 25 | 783 | 852 | −67 | 41* | Comparative Example |
| 21 | D | 12 | 927 | 953 | −39* | 73* | Comparative Example |
| 22 | E | 25 | 936 | 951 | −36* | 75* | Comparative Example |
| 23 | F | 12 | 1037 | 1039 | −41 | 67* | Comparative Example |
| 24 | G | 25 | 986 | 1012 | −38* | 97 | Comparative Example |
| 25 | H | 50 | 953 | 967 | −34* | 96 | Comparative Example |
| 26 | I | 12 | 1053 | 1149 | −32* | 95 | Comparative Example |

Note:
The symbol * means that the parameter deviates from the range specified in the present invention.
Note 2:
Ranges specified in the present invention are as follows: 1. vTrs at the middle of the steel thickness (° C.): −40° C. or lower for steel plates with a tensile strength lower than 1200 MPa: −30° C. or lower for steel plates with a tensile strength of 1200 MPa or higher: 2. Safety index of delayed fracture resistance: 85% or higher for steel plates with a tensile strength lower than 1200 MPa; 80% or higher for steel plates with a tensile strength of 1200 MPa or higher

TABLE 12

| No. | Steels | Thickness (mm) | Yield strength (MPa) | Tensile strength (MPa) | vTrs at the middle of the steel thickness (° C.) | Safety index of delayed fracture resistance (%) | Classification |
|---|---|---|---|---|---|---|---|
| 27 | J | 25 | 1153 | 1213 | −33 | 67* | Comparative Example |
| 28 | K | 50 | 1183 | 1203 | −35 | 69* | Comparative Example |
| 29 | L | 60 | 1012 | 1053 | −23* | 83* | Comparative Example |
| 30 | M | 6 | 1213 | 1216 | −28* | 81 | Comparative Example |
| 31 | N | 12 | 1308 | 1327 | −25* | 78* | Comparative Example |
| 32 | O | 25 | 1297 | 1323 | −24* | 72* | Comparative Example |
| 33 | P | 60 | 1216 | 1218 | −26* | 68* | Comparative Example |
| 34 | Q | 6 | 1309 | 1311 | −35 | 73* | Comparative Example |
| 35 | D | 12 | 1039 | 1058 | −75 | 95 | Example |
| 36 | L | 60 | 1048 | 1093 | −47 | 93 | Example |
| 37 | R | 35 | 1031 | 1063 | −38* | 64* | Comparative Example |
| 38 | S | 50 | 1061 | 1105 | −34* | 61* | Comparative Example |
| 39 | T | 50 | 1015 | 1023 | −29* | 53* | Comparative Example |

TABLE 12-continued

| No. | Steels | Thickness (mm) | Yield strength (MPa) | Tensile strength (MPa) | vTrs at the middle of the steel thickness (° C.) | Safety index of delayed fracture resistance (%) | Classification |
|---|---|---|---|---|---|---|---|
| 40 | U | 60 | 1049 | 1099 | −23* | 55* | Comparative Example |
| 41 | X | 25 | 589 | 661 | −112 | 98 | Example |
| 42 | Y | 6 | 1411 | 1473 | −51 | 88 | Example |
| 43 | Z | 25 | 1459 | 1539 | −53 | 82 | Example |
| 44 | AA | 12 | 1371 | 1606 | −55 | 86 | Example |
| 45 | BB | 32 | 1403 | 1641 | −47 | 86 | Example |
| 46 | CC | 20 | 1451 | 1712 | −51 | 90 | Example |
| 47 | DD | 32 | 1115 | 1143 | −70 | 92 | Example |
| 48 | EE | 16 | 1405 | 1589 | −32 | 62* | Comparative Example |
| 49 | FF | 8 | 1369 | 1551 | −34 | 72* | Comparative Example |
| 50 | GG | 12 | 1351 | 1441 | −32 | 71* | Comparative Example |
| 51 | HH | 12 | 1179 | 1251 | −52 | 72* | Comparative Example |
| 52 | II | 12 | 1181 | 1269 | −39 | 62* | Comparative Example |
| 27 | J | 25 | 1153 | 1213 | −33 | 67* | Comparative Example |
| 28 | K | 50 | 1183 | 1203 | −35 | 69* | Comparative Example |
| 29 | L | 60 | 1012 | 1053 | −23* | 83* | Comparative Example |
| 30 | M | 6 | 1213 | 1216 | −28* | 81 | Comparative Example |
| 31 | N | 12 | 1308 | 1327 | −25* | 78* | Comparative Example |
| 32 | O | 25 | 1297 | 1323 | −24* | 72* | Comparative Example |
| 33 | P | 60 | 1216 | 1218 | −26* | 68* | Comparative Example |
| 34 | Q | 6 | 1309 | 1311 | −35 | 73* | Comparative Example |
| 35 | D | 12 | 1039 | 1058 | −75 | 95 | Example |
| 36 | L | 60 | 1048 | 1093 | −47 | 93 | Example |
| 37 | R | 35 | 1031 | 1063 | −38* | 64* | Comparative Example |
| 38 | S | 50 | 1061 | 1105 | −34* | 61* | Comparative Example |
| 39 | T | 50 | 1015 | 1023 | −29* | 53* | Comparative Example |
| 40 | U | 60 | 1049 | 1099 | −23* | 55* | Comparative Example |
| 41 | X | 25 | 589 | 661 | −112 | 98 | Example |
| 42 | Y | 6 | 1411 | 1473 | −51 | 88 | Example |
| 43 | Z | 25 | 1459 | 1539 | −53 | 82 | Example |
| 44 | AA | 12 | 1371 | 1606 | −55 | 86 | Example |
| 45 | BB | 32 | 1403 | 1641 | −47 | 86 | Example |
| 46 | CC | 20 | 1451 | 1712 | −51 | 90 | Example |
| 47 | DD | 32 | 1115 | 1143 | −70 | 92 | Example |
| 48 | EE | 16 | 1405 | 1589 | −32 | 62* | Comparative Example |
| 49 | FF | 8 | 1369 | 1551 | −34 | 72* | Comparative Example |
| 50 | GG | 12 | 1351 | 1441 | −32 | 71* | Comparative Example |
| 51 | HH | 12 | 1179 | 1251 | −52 | 72* | Comparative Example |
| 52 | II | 12 | 1181 | 1269 | −39 | 62* | Comparative Example |

Note:

The symbol * means that the parameter deviates from the range specified in the present invention.

Note 2:

Ranges specified in the present invention are as follows: 1. vTrs at the middle of the steel thickness (° C.): −40° C. or lower for steel plates with a tensile strength lower than 1200 MPa; −30° C. or lower for steel plates with a tensile strength of 1200 MPa or higher: 2. Safety index of delayed fracture resistance: 85% or higher for steel plates with a tensile strength lower than 1200 MPa; 80% or higher for steel plates with a tensile strength of 1200 MPa or higher

The invention claimed is:

1. A high tensile strength steel plate comprising elements C: 0.02 to 0.25%, Si: 0.01 to 0.8%, Mn: 0.5 to 2.0%, Al: 0.005 to 0.1%, N: 0.0005 to 0.008%, P: 0.02% or lower, Mo: 0.05 to 1.0% and S: 0.003% or lower, all in percent by mass, and Fe and an unavoidable impurity as a balance, having an average aspect ratio of a prior austenite grain calculated over entire thickness of at least three and a cementite covering ratio measured at a boundary of a lath of 50% or lower.

2. The high tensile strength steel plate according to claim 1, further comprising at least one element selected from the group consisting of Nb: 0.1% or lower, V: 0.5% or lower, Ti: 0.1% or lower, Cu: 2% or lower, Ni: 4% or lower, Cr: 2% or lower, and W: 2% or lower, all in percent by mass.

3. The high tensile strength steel plate according to claim 1, further comprising at least one element selected from the group consisting of B: 0.003% or lower, Ca: 0.01% or lower, REM: 0.02% or lower, and Mg: 0.01% or lower, all in percent by mass.

4. The high tensile strength steel plate according to claim 1, wherein hydrogen is charged into the steel and the hydrogen contained in the steel is sealed by zinc galvanizing, a safety index of delayed fracture resistance calculated using the formula described below being at least 75% when a slow strain rate test is performed with a strain rate set to $1\times10^{-3}$/s or lower:

Safety index of delayed fracture resistance (%)=$100\times(X_1/X_0)$ where $X_0$: reduction of area of a specimen substantially free from diffusible hydrogen, and $X_1$: reduction of area of a specimen containing diffusible hydrogen.

5. The high tensile strength steel plate according to claim 4, wherein the safety index of delayed fracture resistance is at least 80%.

6. A method for manufacturing the high tensile strength steel comprising casting steel having a composition according to claim 1 and a safety index of delayed fracture resistance calculated using the formula described below being at least 75% when a slow strain rate test is per-formed with a strain rate set to $1\times10^{-3}$/s or lower:

Safety index of delayed fracture resistance (%)=$100\times(X_1/X_0)$ where $X_0$: reduction of area of a specimen substantially free from diffusible hydrogen, and $X_1$: reduction of area of a specimen containing diffusible hydrogen, comprising:

protecting the steel from cooling to an $Ar_3$ transformation temperature or lower or heating the steel to a temperature equal to or higher than an $Ac_3$ transformation temperature once again, hot rolling to achieve a predetermined steel thickness including rolling conducted with a rolling reduction for a non-recrystallization region set to 30% or higher, cooling the steel from a temperature equal to or higher than the $Ar_3$ transformation temperature to a temperature equal to or lower than 350° C. at a cooling rate of 1° C./s or higher, and tempering the steel at a temperature equal to or lower than an $Ac_1$ transformation temperature.

7. The method according to claim 6, in which the steel is tempered at a temperature equal to or lower than the $Ac_1$ transformation temperature, for manufacturing the high tensile strength steel having a safety index of delayed fracture resistance of at least 80%, wherein a heating apparatus installed in a manufacturing line having a rolling mill and a cooling apparatus is used to heat the steel from 370° C. to a predetermined tempering temperature equal to or lower than the $Ac_1$ transformation temperature while maintaining an average heating rate for heating a middle of a steel thickness at 1° C./s or higher so that a maximum temperature at the middle of the steel thickness is 400° C. or higher.

8. The method according to claim 7, in which the steel is tempered at a temperature equal to or lower than the $Ac_1$ transformation temperature, for manufacturing the high tensile strength steel having a safety index of delayed fracture resistance of at least 80%, wherein the steel is heated from a tempering initiation temperature to 370° C. with an average heating rate for heating the middle of the steel thickness maintained at 2° C./s or higher.

9. A high tensile strength steel comprising elements C: 0.02 to 0.25%, Si: 0.01 to 0.8%, Mn: 0.5 to 2.0%, Al: 0.005 to 0.1%, N: 0.0005 to 0.008%, P: 0.02% or lower, and S: 0.003% or lower, all in percent by mass, and Fe and an unavoidable impurity as a balance, wherein an average aspect ratio of a prior austenite grain calculated over entire thickness is at least three and a cementite covering ratio measured at a boundary of a lath is 50% or lower.

10. The high tensile strength steel according to claim 9, further comprising one or more of Mo: 1% or lower, Nb: 0.1% or lower, V: 0.5% or lower, Ti: 0.1% or lower, Cu: 2% or lower, Ni: 4% or lower, Cr: 2% or lower, and W: 2% or lower, all in percent by mass.

11. The high tensile strength steel according to claim 9, further comprising one or more of B: 0.003% or lower, Ca: 0.01% or lower, REM: 0.02% or lower, and Mg: 0.01% or lower, all in percent by mass.

12. The high tensile strength steel according to claim 9, wherein hydrogen is charged into the steel and the hydrogen contained in the steel is sealed by zinc galvanizing, a safety index of delayed fracture resistance calculated using the formula described below being at least 80% when a slow strain rate test is performed with a strain rate set to $1\times10^{-3}$/s or lower:

Safety index of delayed fracture resistance (%)=$100\times(X_1/X_0)$ where $X_0$: reduction of area of a specimen substantially free from diffusible hydrogen, and $X_1$: reduction of area of a specimen containing diffusible hydrogen.

13. A method for manufacturing the high tensile strength steel comprising casting steel having the composition according to claim 9 and a safety index of delayed fracture resistance calculated using the formula described below being at least 80% when a slow strain rate test is per-formed with a strain rate set to $1\times10^{-3}$/s or lower:

Safety index of delayed fracture resistance (%)=$100\times(X_1/X_0)$ where $X_0$: reduction of area of a specimen substantially free from diffusible hydrogen, and $X_1$: reduction of area of a specimen containing diffusible hydrogen comprising:

protecting the steel from cooling to an $Ar_3$ transformation temperature or lower or heating the steel to a temperature equal to or higher than an $Ac_3$ transformation temperature once again, hot rolling to achieve a predetermined steel thickness including rolling conducted with a rolling reduction for a non-recrystallization region set to 30% or higher, cooling the steel from a temperature equal to or higher than the $Ar_3$ transformation temperature to a temperature equal to or lower than 350° C. at a cooling rate of 1° C./s or higher, and tempering the steel using a heating apparatus installed in a manufacturing line having a rolling mill and a cooling apparatus with an average heating rate for heating a middle of a steel thickness from 370° C. to a predetermined tempering temperature equal to or lower than the $Ac_1$ transformation temperature maintained at 1° C./s or higher so that a maximum temperature at the middle of the steel thickness is 400° C. or higher.

14. A method for manufacturing the high tensile strength steel comprising casting steel having the composition according to claim 9 and a safety index of delayed fracture resistance calculated using the formula described below being at least 80% when a slow strain rate test is performed with a strain rate set to $1\times10^{-3}$/s or lower:

Safety index of delayed fracture resistance (%)=$100\times(X_1/X_0)$ where $X_0$: reduction of area of a specimen substantially free from diffusible hydrogen, and $X_1$: reduction of area of a specimen containing diffusible hydrogen comprising:

protecting the steel from cooling to an $Ar_3$ transformation temperature or lower or heating the steel to a temperature equal to or higher than an $Ac_3$ transformation temperature once again, hot rolling to achieve a predetermined steel thickness including rolling conducted with a rolling reduction for a non-recrystallization region set to 30% or higher, cooling the steel from a temperature equal to or higher than the $Ar_3$ transformation temperature to a temperature equal to or lower than 350° C. at a cooling rate of 1° C./s or higher, and tempering the steel using a heating apparatus installed in a manufacturing line having a rolling mill and a cooling apparatus with an average heating rate for heating a middle of a steel thickness from a tempering initiation temperature to 370° C. maintained at 2° C./s or higher and an average heating rate for heating the middle of the steel thickness from 370° C. to a predetermined tempering temperature equal to or lower than an $Ac_1$ transformation temperature maintained at 1° C./s or higher so that a maximum temperature at the middle of the steel thickness is 400° C. or higher.

* * * * *